US012741784B2

(12) United States Patent
Shishido et al.

(10) Patent No.: US 12,741,784 B2
(45) Date of Patent: Sep. 22, 2026

(54) ARTICLE STORAGE DEVICE

(71) Applicant: HONDA MOTOR CO., LTD., Tokyo (JP)

(72) Inventors: Makoto Shishido, Saitama (JP); Yasutaka Yoshikawa, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 72 days.

(21) Appl. No.: 18/695,821

(22) PCT Filed: Sep. 27, 2021

(86) PCT No.: PCT/JP2021/035431
§ 371 (c)(1),
(2) Date: Mar. 27, 2024

(87) PCT Pub. No.: WO2023/047596
PCT Pub. Date: Mar. 30, 2023

(65) Prior Publication Data

US 2024/0400259 A1 Dec. 5, 2024

(51) Int. Cl.
*B65D 21/02* (2006.01)
*B65D 25/20* (2006.01)

(52) U.S. Cl.
CPC ..... *B65D 21/023* (2013.01); *B65D 25/20* (2013.01)

(58) Field of Classification Search
CPC ..... B65D 21/023; B65D 25/20; B60R 5/00
See application file for complete search history.

(56) References Cited

U.S. PATENT DOCUMENTS 7,916,022 B2 * 3/2011 Wilcox ..... G06Q 10/08 340/568.1
9,702,610 B2 * 7/2017 Iwasa ..... H02J 50/12
(Continued)

FOREIGN PATENT DOCUMENTS

CN 103887894 A 6/2014
JP S55-159584 U 11/1980
(Continued)

OTHER PUBLICATIONS

Dec. 14, 2021, Translation of International Search Opinion issued for related PCT Application No. PCT/JP2021/035431.
(Continued)

*Primary Examiner* — Andrew D Perreault
(74) *Attorney, Agent, or Firm* — Paratus Law Group, PLLC

(57) ABSTRACT

An article storage device, includes: a plurality of luggage cargos configured to store an article; and a base member configured to allow the plurality of luggage cargos to be stacked, wherein an upper surface of the base member and upper surfaces of the luggage cargos are each provided with an engaging portion, lower surfaces of the luggage cargos are each provided with an engaged portion configured to detachably engage with the engaging portion, the plurality of luggage cargos include a first luggage cargo and a second luggage cargo having the same width dimension and different height dimensions, and the luggage cargos are each configured to be stacked on the base member by the engaged portion engaging with the engaging portion of the base member or a different luggage cargo.

9 Claims, 10 Drawing Sheets

(56) References Cited

U.S. PATENT DOCUMENTS

| | | | |
|---|---|---|---|
| 2013/0312450 | A1 | 11/2013 | Iwasa et al. |
| 2019/0232504 | A1 | 8/2019 | Radetzki et al. |
| 2021/0155146 | A1 | 5/2021 | Yabushita et al. |

FOREIGN PATENT DOCUMENTS

| | | | |
|---|---|---|---|
| JP | S61-104985 | A | 5/1986 |
| JP | 2010-108714 | A | 5/2010 |
| JP | 2011-205780 | A | 10/2011 |
| JP | 2013-162567 | A | 8/2013 |
| JP | 2019-177862 | A | 10/2019 |
| JP | 2021-079885 | A | 5/2021 |
| KR | 10-2020-0046597 | A | 5/2020 |
| WO | WO 2013/027761 | A1 | 2/2013 |

OTHER PUBLICATIONS

Oct. 8, 2024, translation of Japanese Office Action issued for related JP Application No. 2023-549310.
Dec. 14, 2021, Translation of International Search Report issued for related PCT Application No. PCT/JP2021/035431.

* cited by examiner

ARTICLE STORAGE DEVICE

CROSS REFERENCE TO PRIOR APPLICATION

This application is a National Stage Patent Application of PCT International Patent Application No. PCT/JP2021/035431 (filed on Sep. 27, 2021) under 35 U.S.C. § 371, which is hereby incorporated by reference in its entirety.

TECHNICAL FIELD

The present invention relates to an article storage device.

BACKGROUND ART

In the related art, there has been an article storage device mounted on a delivery vehicle or the like. From the viewpoint of security or the like, an article storage device is provided with a luggage cargo for each article to be stored. It is preferable that the luggage cargo for taking in and out the article can be opened and closed alone as appropriate. Furthermore, from the viewpoint of space efficiency, it is preferable that each luggage cargo has a dimension corresponding to the dimension of the article to be stored.

For example, Patent Literature 1 discloses an article storage device in which storage chambers of different dimensions can be added to a cargo box by connecting an extension module to a base element.

CITATION LIST

Patent Literature

Patent Literature 1: JP2019-177862A

SUMMARY OF INVENTION

Technical Problem

However, the article storage device of Patent Literature 1 needs to connect the base element to the cargo box, which remarkably increases the cost. Further, the height dimension of the storage chamber added by connecting the extension module to the base element is limited by the height dimension of the base element, which makes it difficult to arrange a plurality of storage chambers having different height dimensions with a high degree of freedom in the upper-lower direction.

The present invention provides an article storage device in which luggage cargos having different height dimensions can be stacked on a base member while being combined with a high degree of freedom in the upper-lower direction, without moving relative to the base member.

Solution to Problem

A first of the present invention is an article storage device, including:

a plurality of luggage cargos configured to store an article; and a base member configured to allow the plurality of luggage cargos to be stacked, in which an upper surface of the base member and upper surfaces of the luggage cargos are each provided with an engaging portion, lower surfaces of the luggage cargos are each provided with an engaged portion configured to detachably engage with the engaging portion, the plurality of luggage cargos include a first luggage cargo and a second luggage cargo having the same width dimension and different height dimensions, and the luggage cargos are each configured to be stacked on the base member by the engaged portion engaging with the engaging portion of the base member or a different luggage cargo.

A second of the present invention is an article storage device, including:

a plurality of luggage cargos configured to store an article;

a base member configured to allow the plurality of luggage cargos to be stacked; and a panel member provided with a panel-side connector, in which an upper surface of the base member is provided with an engaging portion, the luggage cargos are each provided with a luggage cargo-side connector configured to be conducted to the panel-side connector, lower surfaces of the luggage cargos are each provided with an engaged portion configured to detachably engage with the engaging portion, the plurality of luggage cargos include a first luggage cargo and a second luggage cargo having the same width dimension and different height dimensions, the panel member is coupled to the base member, and the luggage cargos are each configured to be stacked on the base member by the engaged portion engaging with the engaging portion of the base member.

Advantageous Effects of Invention

According to the present invention, luggage cargos having different height dimensions can be stacked on the base member while being combined with a high degree of freedom in the upper-lower direction, without moving relative to the base member.

DESCRIPTION OF EMBODIMENTS

Figure 1:
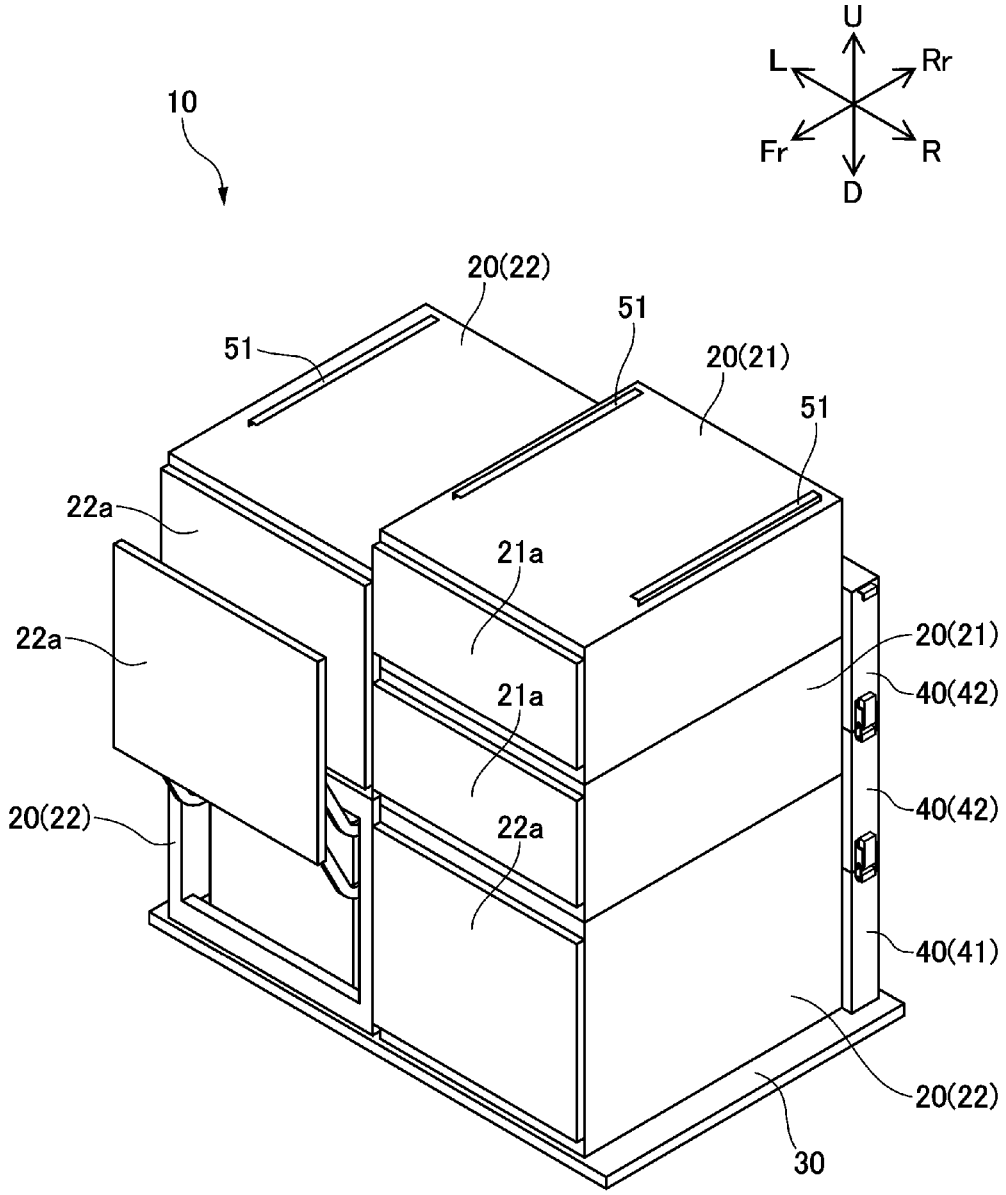
FIG. 1 is an overall perspective view of an article storage device according to an embodiment of the present invention as viewed obliquely from the above.

Hereinafter, an embodiment of an article storage device of the present invention will be described with reference to the accompanying drawings. The drawings are viewed from directions of reference numerals. Further, in the present specification and the like, in order to simplify and clarify the description, each of front and rear, right and left, and upper and lower directions is defined such that a vertical direction is defined as the upper-lower direction, and for convenience, an opening direction of each luggage cargo is defined as the front-rear direction, and the left-right direction is defined according to the opening direction of each luggage cargo, that is, a direction in which an article storage device is viewed from the front side. In the drawings, the front side is denoted by Fr, the rear side is denoted by Rr, the left side is denoted by L, the right side is denoted by R, the upper side is denoted by U, and the lower side is denoted by D. In the present specification and the like, the left-right direction is also referred to as the width direction, and the front-rear direction is also referred to as the depth direction.

As illustrated in FIG. 1, an article storage device 10 of the present embodiment includes: a plurality of luggage cargos 20 capable of storing articles; a base member 30 that allows the plurality of luggage cargos 20 to be stacked; and a plurality of panel members 40 attached to the rear end of the base member 30 and extending in the upper-lower direction and the left-right direction. The article storage device 10 is mounted on, for example, a delivery vehicle or a carriage (not illustrated).

<Luggage Cargos>

Figure 2:
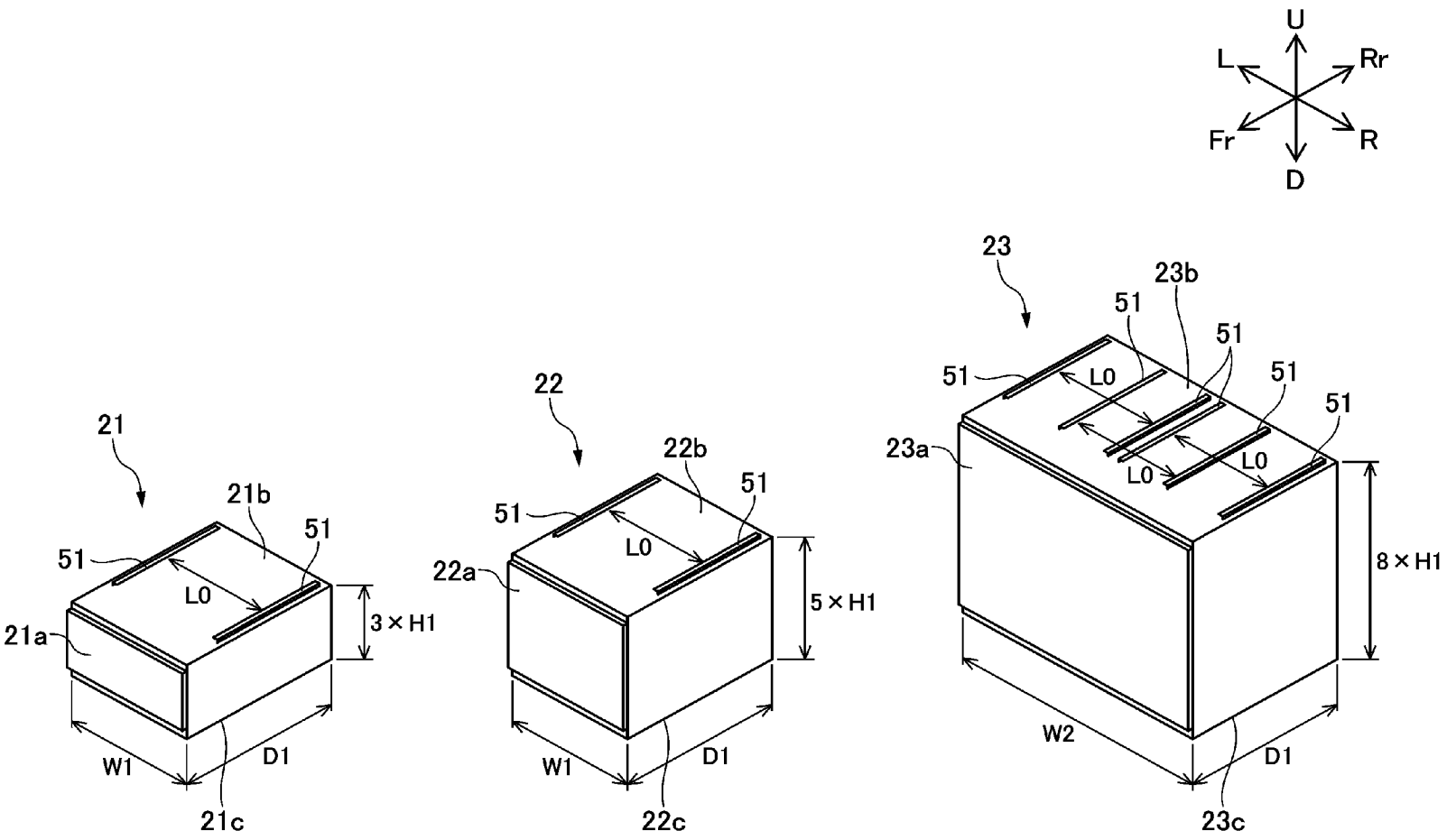
FIG. 2 is a perspective view of a first luggage cargo, a second luggage cargo, and a third luggage cargo in the article storage device of FIG. 1 as viewed obliquely from above.

As illustrated in FIGS. 1 and 2, in the present embodiment, the plurality of luggage cargos 20 each have a substantially rectangular parallelepiped shape. The plurality of luggage cargos 20 include first luggage cargos 21, second luggage cargos 22, and third luggage cargos 23. The first luggage cargos 21 and the second luggage cargos 22 have the same width dimension W1 and the same depth dimension D1. The first luggage cargos 21 have a height dimension of three times the unit height dimension H1, that is, 3×H1. On the other hand, the second luggage cargos 22 have a height dimension of five times the unit height dimension H1, that is, 5×H1. The third luggage cargos 23 have a width dimension W2 of about twice the width dimension W1, a depth dimension D1 the same as the first luggage cargo 21 and the second luggage cargo 22, and a height dimension of eight times the unit height dimension H1, that is, 8×H1.

The first luggage cargos 21, the second luggage cargos 22, and the third luggage cargos 23 respectively include door members 21*a*, 22*a*, and 23*a* capable of opening and closing openings that open forward. The door members 21*a*, 22*a*, and 23*a* may be openable and closable electrically or may be openable and closable manually.

The first luggage cargos 21, the second luggage cargos 22, and the third luggage cargos 23 area each provided with an electronic lock (not illustrated). Due to this electronic lock, the door members 21*a*, 22*a*, and 23*a* are locked to and unlocked from the first luggage cargos 21, the second luggage cargos 22, and the third luggage cargos 23, respectively. The electronic lock uses electric power to switch the door members 21*a*, 22*a*, and 23*a* between the states of being locked to and unlocked from the first luggage cargos 21, the second luggage cargos 22, and the third luggage cargos 23, respectively.

<Base Member>

Figure 3:
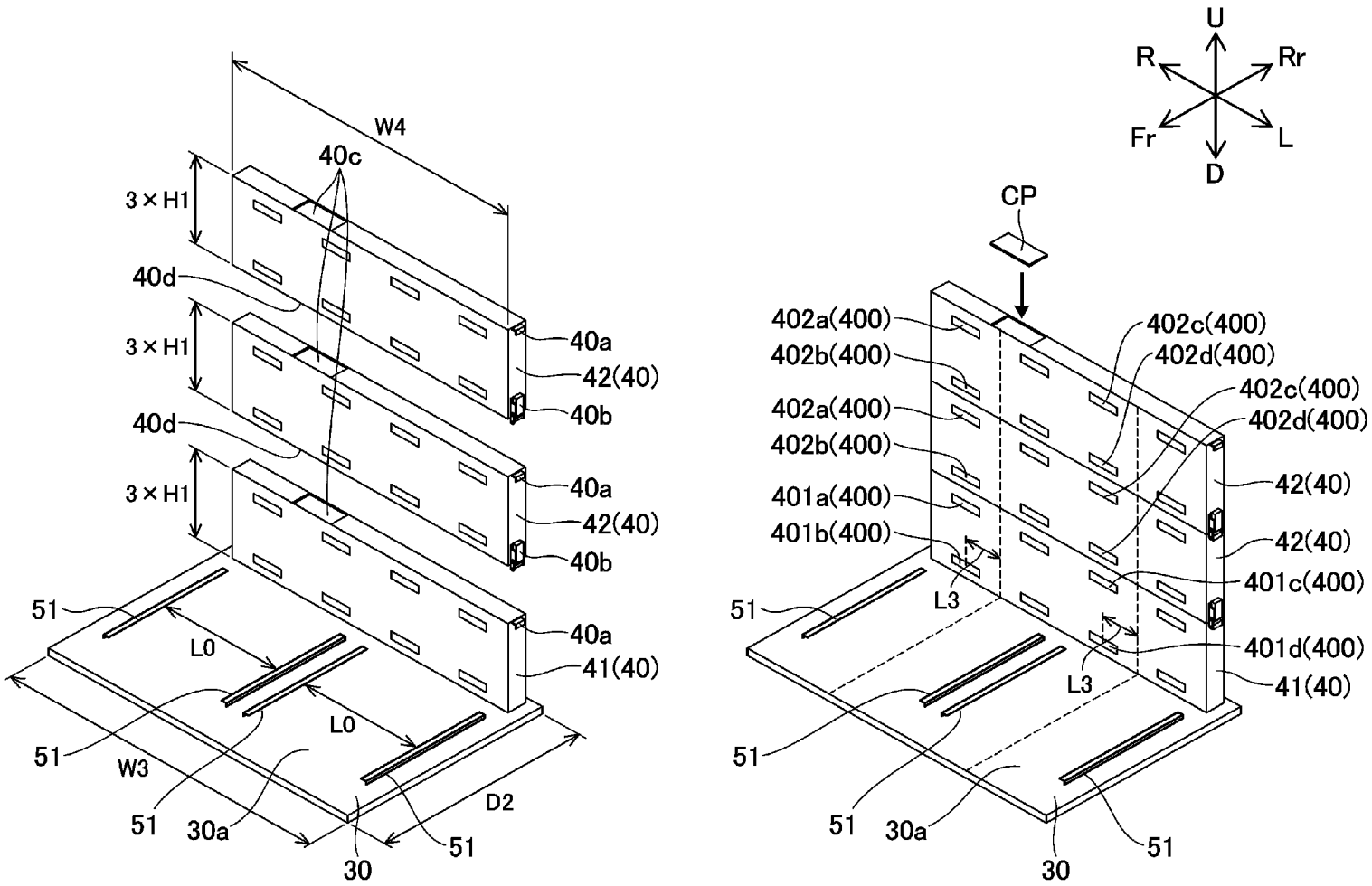
FIG. 3 is a perspective view of a base member, a first panel member, and a second panel member in the article storage device of FIG. 1 as viewed obliquely from above.

As illustrated in FIG. 3, the base member 30 extends in the front-rear direction and the left-right direction and has a substantially rectangular flat plate shape when viewed from above. The base member 30 has a width dimension W3 about twice the width dimension W1 and substantially the same as the width dimension W2. The base member 30 has a depth dimension D2 larger than the depth dimension D1 of the first luggage cargos 21, the second luggage cargos 22, and the third luggage cargos 23. Accordingly, the first luggage cargos 21, the second luggage cargos 22, and the third luggage cargos 23 can be all stacked on the upper surface 30*a* of the base member 30 without protruding from the base member 30 when viewed from above.

<Stacking of Luggage Cargos>

The upper surface 30*a* of the base member 30 is provided with engagement rails 51. The engagement rails 51 provided on the upper surface 30*a* of the base member 30 are a pair of left and right rails extending in the front-rear direction and spaced apart by a predetermined distance L0 in the left-right direction. In the present embodiment, the left region and the right region of the upper surface 30*a* of the base member 30 are each provided with one pair of left and right engagement rails 51, two pairs aligned in the left-right direction in total. The cross-sectional shape of each engagement rail 51 when viewed from the front-rear direction is a substantially L shape, whose upper end is formed with a protruding portion 51*a* protruding toward the other one between the pair of left and right engagement rails 51.

As illustrated in FIG. 2, the upper surfaces 21*b* and 22*b* of each first luggage cargo 21 and second luggage cargo 22 are each provided with engagement rails 51. In the present embodiment, the engagement rails 51 have the same shape as the engagement rails 51 provided on the upper surface 30*a* of the base member 30, and are a pair of left and right rails extending in the front-rear direction and spaced apart by a predetermined distance L0 in the left-right direction.

The upper surface 23*b* of each third luggage cargo 23 is provided with engagement rails 51. The engagement rails 51 provided on the upper surface 23*b* of the third luggage cargo 23 have the same shape as the engagement rails 51 provided on the upper surfaces 21*b* and 22*b* of the first luggage cargo 21 and the second luggage cargo 22, and are a pair of left and right rails extending in the front-rear direction and spaced apart by a predetermined distance L0 in the left-right direction. In the present embodiment, the left region and the right region of the upper surface 23*b* of the third luggage cargo 23 are each provided with one pair of left and right engagement rails 51, and the central region of the upper surface 23*b* of the third luggage cargo 23 is further provided with one pair, three pairs aligned in the left-right direction in total. Between the pair of left and right engagement rails 51 provided in the central region of the upper surface 23*b* of the third luggage cargo 23, the left engagement rail 51 is arranged left to the right engagement rail 51 between the pair of left and right engagement rails 51 provided in the left region of the upper surface 23*b* of the third luggage cargo 23, and the right engagement rail 51 is arranged right to the left engagement rail 51 between the pair of left and right engagement rails 51 provided in the right region of the upper surface 23*b* of the third luggage cargo 23.

Figure 4:
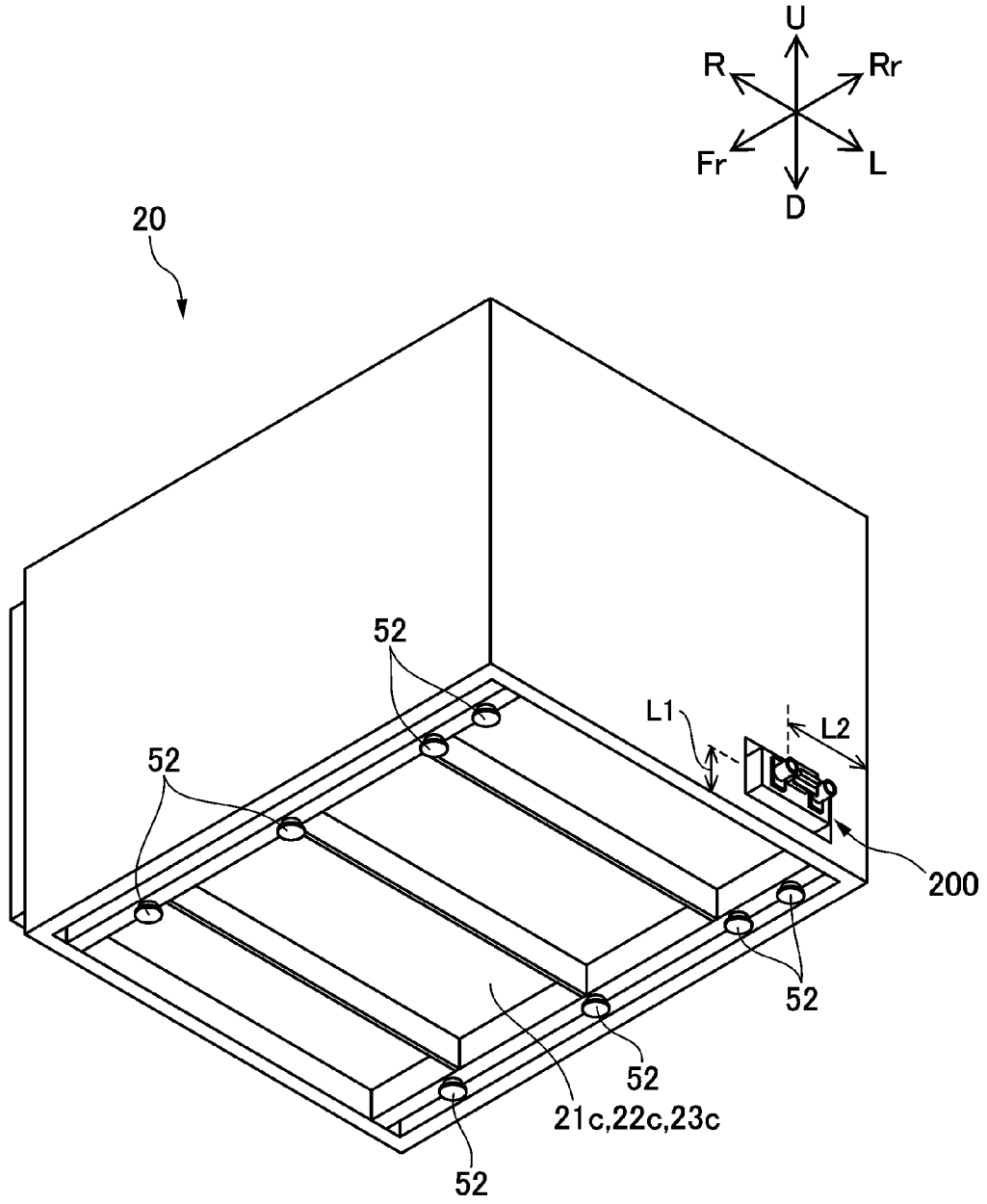
FIG. 4 is a perspective view illustrating the lower surface and the rear surface of a luggage cargo in the article storage device of FIG. 1.

As illustrated in FIG. 4, lower surfaces 21*c*, 22*c*, 23*c* of the first luggage cargo 21, the second luggage cargo 22, and the third luggage cargo 23 are each provided with legs 52 that can detachably engage with the pairs of left and right engagement rails 51. The left ends and the right ends of the lower surfaces 21*c*, 22*c*, and 23*c* of the first luggage cargo 21, the second luggage cargo 22, and the third luggage cargo 23 are each provided with a plurality of legs 52 (four in the present embodiment) aligned in the front-rear direction. The legs 52 have a columnar shape protruding downward from the lower surfaces 21*c*, 22*c*, and 23*c* of the first luggage cargo 21, the second luggage cargo 22, and the third luggage cargo 23, and each have a flange 52*a* formed at the lower end thereof. In the left-right direction, the legs 52 provided at the left ends and the legs 52 provided at the right ends of the lower surfaces 21*c*, 22*c*, 23*c* of the first luggage cargo 21, the second luggage cargo 22, and the third luggage cargo 23 are provided at positions offset from the centers in the left-right direction of the first luggage cargo 21, the second luggage cargo 22, and the third luggage cargo 23 by the same distance in the left and right directions, respectively.

Figure 5:
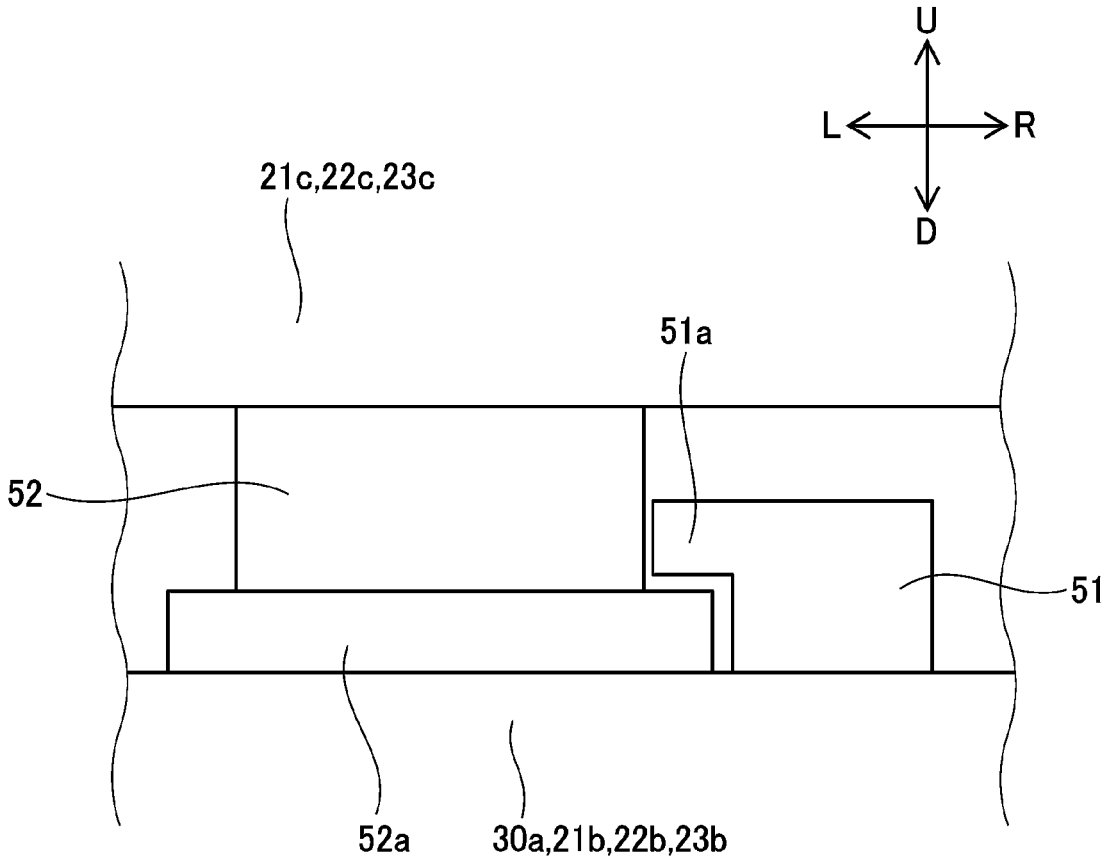
FIG. 5 is a diagram illustrating a state in which engagement rails and legs are engaged in the article storage device of FIG. 1.

As illustrated in FIG. 5, to stack the first luggage cargo 21 on the upper surface 30*a* of the base member 30, the first luggage cargo 21 is slid rearward from the front side while the flanges 52*a* of the legs 52 provided at the left end engage with the protruding portion 51*a* of the left engagement rail 51 between the pair of left and right engagement rails 51 provided on the upper surface 30*a* of the base member 30 and the flanges 52*a* of the legs 52 provided at the right end engage with the protruding portion 51*a* of the right engagement rail 51 between the pair of left and right engagement rails 51 provided on the upper surface 30*a* of the base member 30. Accordingly, the first luggage cargo 21 is stacked on the upper surface 30*a* of the base member 30 by engaging with the upper surface 30*a* of the base member 30.

To stack the first luggage cargo 21 on the upper surface 21*b* of a different first luggage cargo 21, the upper surface 22*b* of a second luggage cargo 22, or the upper surface 23*b* of a third luggage cargo 23, the first luggage cargo 21 is slid rearward from the front while the flanges 52*a* of the legs 52 provided at the left end engage with the protruding portion 51*a* of the left engagement rail 51 between the pair of left and right engagement rails 51 provided on the upper surface 21*b* of the different first luggage cargo 21, the upper surface 22*b* of the second luggage cargo 22, or the upper surface 23*b* of the third luggage cargo 23, and the flanges 52*a* of the legs 52 provided at the right end engage with the protruding portion 51*a* of the right engagement rail 51 between the pair of left and right engagement rails 51 provided on the upper surface 21*b* of the different first luggage cargo 21, the upper surface 22*b* of the second luggage cargo 22, or the upper surface 23*b* of the third luggage cargo 23. Accordingly, the first luggage cargo 21 is stacked on the upper surface 21*b* of the different first luggage cargo 21, the upper surface 22*b* of the second luggage cargo 22, or the upper surface 23*b* of the third luggage cargo 23 by engaging with the upper surface 21*b* of the different first luggage cargo 21, the upper surface 22*b* of the second luggage cargo 22, or the upper surface 23*b* of the third luggage cargo 23.

To stack the second luggage cargo 22 on the upper surface 30*a* of the base member 30, the second luggage cargo 22 is slid rearward from the front while the flanges 52*a* of the legs 52 provided at the left end engage with the protruding portion 51*a* of the left engagement rail 51 between the pair of left and right engagement rails 51 provided on the upper surface 30*a* of the base member 30 and the flanges 52*a* of the legs 52 provided at the right end engage with the protruding portion 51*a* of the right engagement rail 51 between the pair of left and right engagement rails 51 provided on the upper surface 30*a* of the base member 30. Accordingly, the second luggage cargo 22 is stacked on the upper surface 30*a* of the base member 30 by engaging with the upper surface 30*a* of the base member 30.

To stack the second luggage cargo 22 on the upper surface 21*b* of a first luggage cargo 21, the upper surface 22*b* of a different second luggage cargo 22, or the upper surface 23*b* of a third luggage cargo 23, the second luggage cargo 22 is slid rearward from the front while the flanges 52*a* of the legs 52 provided at the left end engage with the protruding portion 51*a* of the left engagement rail 51 between the pair of left and right engagement rails 51 provided on the upper surface 21*b* of the first luggage cargo 21, the upper surface 22*b* of the different second luggage cargo 22, or the upper surface 23*b* of the third luggage cargo 23, and the flanges 52*a* of the legs 52 provided at the right end engage with the protruding portion 51*a* of the right engagement rail 51 between the pair of left and right engagement rails 51 provided on the upper surface 21*b* of the first luggage cargo 21, the upper surface 22*b* of the different second luggage cargo 22, or the upper surface 23*b* of the third luggage cargo 23. Accordingly, the second luggage cargo 22 is stacked on the upper surface 21*b* of the first luggage cargo 21, the upper surface 22*b* of the different second luggage cargo 22, or the upper surface 23*b* of the third luggage cargo 23 by engaging with the upper surface 21*b* of the first luggage cargo 21, the upper surface 22*b* of the different second luggage cargo 22, or the upper surface 23*b* of the third luggage cargo 23.

To stack the third luggage cargo 23 on the upper surface 30*a* of the base member 30, the third luggage cargo 23 is slid rearward from the front while the flanges 52*a* of the legs 52 provided at the left end engage with the protruding portion 51*a* of the left engagement rail 51 between the pair of left and right engagement rails 51 provided in the left region of the upper surface 30*a* of the base member 30 among the two pairs of left and right engagement rails 51 provided on the upper surface 30*a* of the base member 30, and the flanges 52*a* of the legs 52 provided at the right end engage with the protruding portion 51*a* of the right engagement rail 51 between the pair of left and right engagement rails 51 provided in the right region of the upper surface 30*a* of the base member 30 among the two pairs of left and right engagement rails 51 provided on the upper surface 30*a* of the base member 30. Accordingly, the third luggage cargo 23 is stacked on the upper surface 30*a* of the base member 30 by engaging with the upper surface 30*a* of the base member 30.

As described above, each luggage cargo 20 can be stacked on the base member 30 by the legs 52 of the luggage cargo 20 engaging with the engagement rails 51 of the base member 30 or a different luggage cargo 20.

Accordingly, the first luggage cargo 21 and the second luggage cargo 22 can be stacked on the base member 30 by engaging with the base member 30, and the first luggage cargo 21 and the second luggage cargo 22 can be stacked on the upper surface 21*b*, 22*b* of a first luggage cargo 21 or a second luggage cargo 22 below by engaging with the first luggage cargo 21 or the second luggage cargo 22. Accordingly, the luggage cargos 20 having different height dimensions can be stacked in the upper-lower direction by engaging with the base member 30 and the luggage cargo 20 below, so that the luggage cargos 20 having different height dimensions can be stacked on the base member 30 while being combined with a high degree of freedom in the upper-lower direction, without moving relative to the base member 30 or the luggage cargo 20 below.

<Panel Members>

As illustrated in FIG. 3, the plurality of panel members 40 are coupled in the upper-lower direction at the rear end of the base member 30. The plurality of panel members 40 include first panel members 41 and second panel members 42. The first panel members 41 and the second panel members 42 are substantially rectangular members extending in the upper-lower direction and the left-right direction with a predetermined thickness in the front-rear direction. In the present embodiment, the first panel members 41 and the second panel members 42 have the same size. The first panel members 41 and the second panel members 42 have a height dimension of three times the unit height dimension H1, that is, 3×H1. Accordingly, the height dimensions of the first panel member 41 and the second panel member 42 are the same as the height dimension of the first luggage cargos 21. The first panel members 41 and the second panel members 42 have a width dimension of about twice the width dimension W1, and have a width dimension W4 substantially equal to the width dimension W3. A first panel member 41 is coupled to the base member 30 while being placed at the rear end of the upper surface 30*a* of the base member 30. A second panel member 42 can be detachably coupled to a first panel member 41 or a different second panel member 42 in the upper-lower direction.

The upper ends of the left and right side surfaces of the first panel member 41 and the second panel member 42 are each provided with a claw 40*a*. The lower ends of left and right side surfaces of the second panel member 42 are each provided with a fastening lever 40*b* engageable with the claw 40*a*. The tightening lever 40*b* of the second panel member 42 engages with the claw 40*a* of a first panel member 41 or a second panel member 42 arranged below the second panel member 42. Accordingly, the second panel member 42 is coupled to the first panel member 41 or the second panel member 42 arranged below the second panel member 42 in the upper-lower direction. FIG. 3 illustrates an example in which a second panel member 42 is coupled to the upper surface of a first panel member 41, and a different second panel member 42 is coupled to the upper surface of the second panel member 42. In this way, in FIG. 3, the three panel members 40, specifically, the one first panel member 41 and the two second panel members 42 are coupled in the upper-lower direction.

The upper surfaces of the first panel member 41 and the second panel member 42 are each provided with an upper surface connector 40*c*, and the lower surface of the second panel member 42 is provided with a lower surface connector 40*d* that can be conducted to the upper surface connector 40*c*. If the second panel member 42 is coupled to the upper side of a first panel member 41 or a different second panel member 42, the lower surface connector 40*d* is conducted to the upper surface connector 40*c* of the first panel member 41 or the second panel member 42 arranged below the second panel member 42. Thus, a plurality of panel members 40 coupled in the upper-lower direction at the rear end of the base member 30 are electrically connected to each other.

The upper surface connector 40*c* of the panel member 40 arranged at the uppermost stage has a cap CP fitted thereto. The cap CP can prevent foreign matters such as water or dust from entering the upper surface connector 40*c* of the panel member 40 arranged at the uppermost stage, and can prevent the upper surface connector 40*c* of the panel member 40 arranged at the uppermost stage from being conducted to an unintended member.

<Conduction Between Luggage Cargos and Panel Members>

Figure 6:
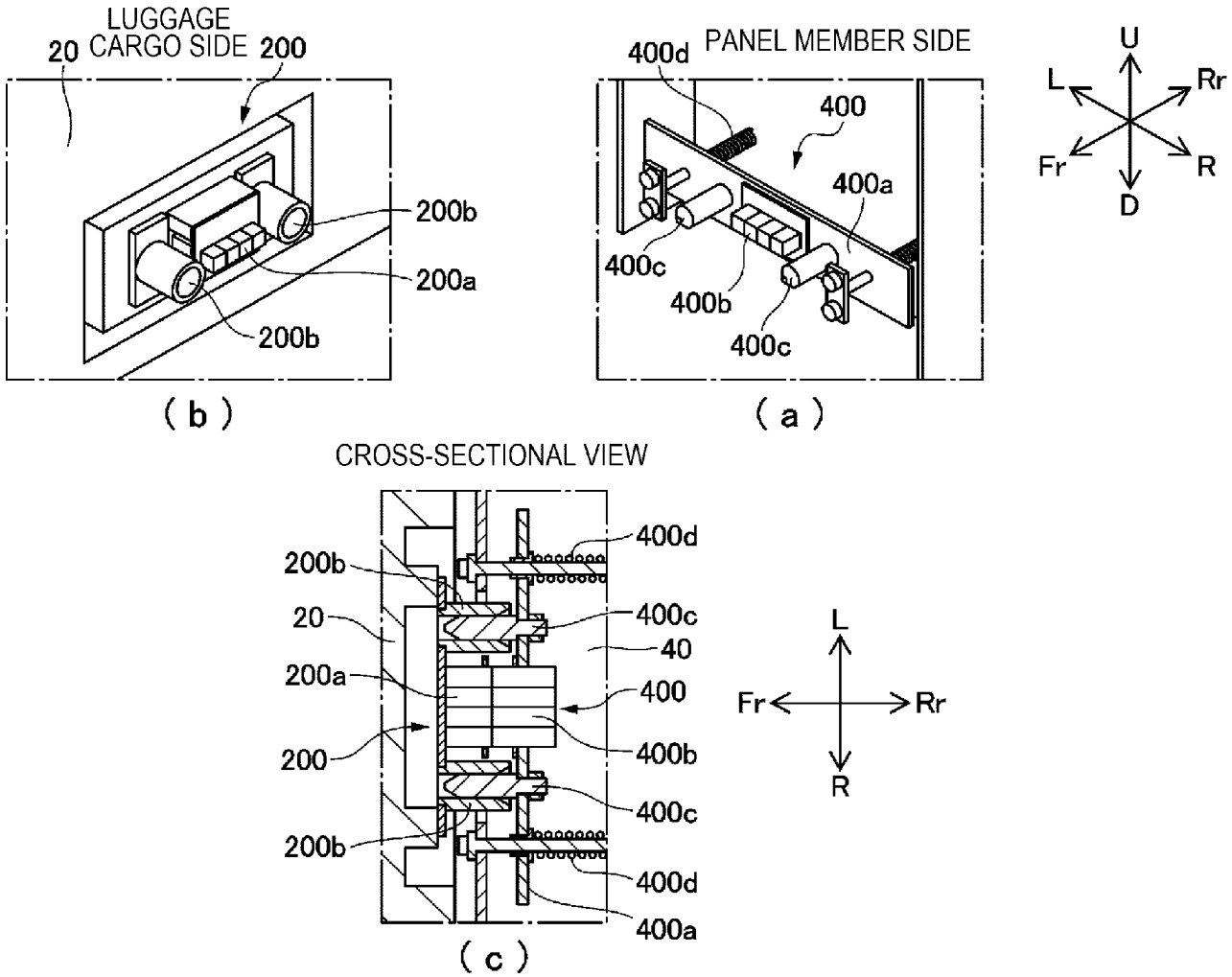
In FIG. 6, (a) is an enlarged view of a panel-side connector provided on a panel member, (b) is an enlarged view of a luggage cargo-side connector provided on a luggage cargo, and (c) is a diagram illustrating a state where the luggage cargo-side connector and the panel-side connector are coupled and conducted.

As illustrated in (a) of FIG. 6, the panel members 40 are each provided with a panel-side connector 400. The panel-side connector 400 includes a pedestal 400*a*, a connector terminal 400*b* fixed to the pedestal 400*a* so as to face forward, and a pair of left and right positioning pins 400*c* fixed to the pedestal 400*a* so as to face forward with the connector terminal 400*b* interposed therebetween in the left-right direction. The pedestal 400*a* is supported on the panel member 40 by a pair of left and right coil springs 400*d*. The front surface of the panel member 40 is open in a region overlapping the connector terminal 400*b* and the positioning pins 400*c* when viewed in the front-rear direction. Accordingly, the panel-side connector 400 is provided on the panel member 40 such that the connector terminal 400*b* and the positioning pins 400*c* can be accessed from the front of the panel member 40.

As illustrated in (b) of FIG. 6, the rear surface of each luggage cargo 20 is provided with a luggage cargo-side connector 200 that can be conducted to the panel-side connector 400 of the panel member 40. The luggage cargo-side connector 200 includes a connector terminal 200*a* fixed to the rear surface of the luggage cargo 20 so as to face rearward, and a pair of left and right bushes 200*b* fixed to the rear surface of the luggage cargo 20 so as to face rearward with the connector terminal 200*a* interposed therebetween in the left-right direction. The bushes 200*b* have a shape that can be fitted to the positioning pins 400*c* of the panel-side connector 400.

As illustrated in (c) of FIG. 6, the luggage cargo-side connector 200 of each of the luggage cargos 20 is coupled to the panel-side connector 400 such that the positioning pins 400*c* of the panel-side connector 400 and the bushes 200*b* are fitted to each other, so that the connector terminal 200*a* of the luggage cargo-side connector 200 and the connector terminal 400*b* of the panel-side connector 400 are coupled to each other and the luggage cargo-side connector 200 is conducted to the panel-side connector 400. At this time, the pair of left and right coil springs 400*d* provided on the panel member 40 absorb dimensional errors of the luggage cargos 20 and the panel members 40, assembly errors of the plurality of panel members 40, rattling between the engagement rails 51 and the legs 52, and the like. Therefore, it is possible to connect the luggage cargo-side connector 200 of each luggage cargo 20 to the panel-side connector 400 in a reliably conducted state.

Figure 9:
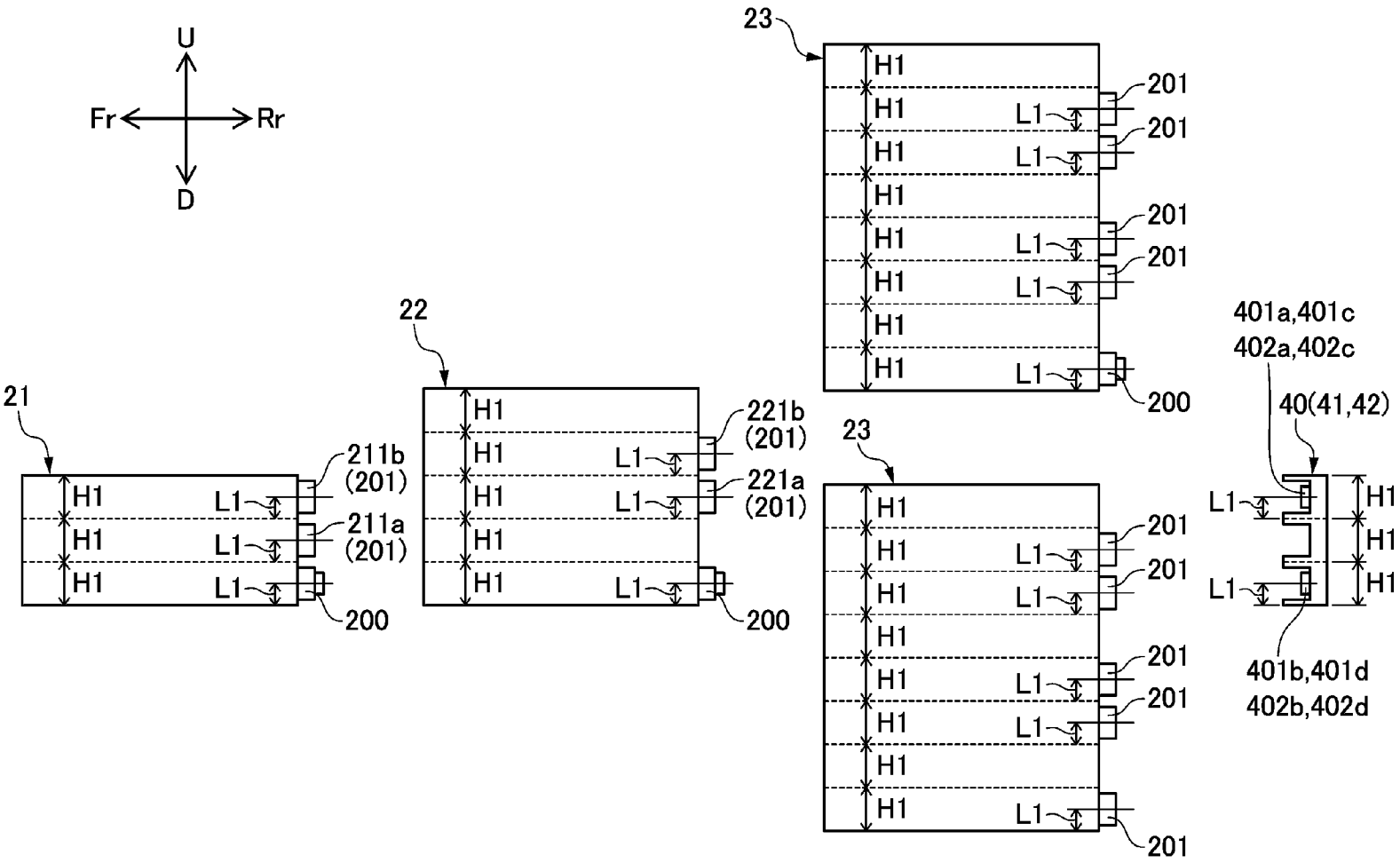
FIG. 9 is a diagram illustrating the arrangement of the luggage cargo-side connectors and dummy connectors of the first luggage cargo, the second luggage cargo, and the third luggage cargo and the arrangement of the panel-side connectors of the panel members in the article storage device of FIG. 1.

As illustrated in FIGS. 3 and 9, if the luggage cargo 20 is stacked on the upper surface 30*a* of the base member 30 by the legs 52 of the luggage cargo 20 engaging with the engagement rails 51 provided on the upper surface 30*a* of the base member 30, the luggage cargo-side connector 200 is provided at a first distance L1 above the upper surface 30*a* of the base member 30 in the upper-lower direction. Accordingly, in the present embodiment, the luggage cargo-side connector 200 is provided at the first distance L1 above the lower end of the luggage cargo 20, that is, the lower ends of the legs 52 in the upper-lower direction. The luggage cargo-side connector 200 is provided at a second distance L2 from the left surface of the luggage cargo 20 in the left-right direction.

Each first panel member 41 is provided with four panel-side connectors 400. Similarly to the first panel member 41, each second panel member 42 is provided with four panel-side connectors 400.

The panel-side connectors 400 provided on the first panel member 41 includes a panel-side upper left connector 401*a* provided on the upper left region of the front surface of the first panel member 41, a panel-side lower left connector 401*b* provided in the lower left region of the front surface of the first panel member 41, a panel-side upper right connector 401*c* provided in the upper right region of the front surface of the first panel member 41, and a panel-side lower right connector 401*d* provided in the lower right region of the front surface of the first panel member 41.

If the first panel member 41 is coupled to the base member 30, the panel-side lower left connector 401*b* and the panel-side lower right connector 401*d* are provided at the first distance L1 above the upper surface 30*a* of the base member 30 in the upper-lower direction. Accordingly, in the present embodiment, the panel-side lower left connector 401*b* and the panel-side lower right connector 401*d* are provided at the first distance L1 above the lower surface of the first panel member 41 in the upper-lower direction. If the first panel member 41 is coupled to the base member 30, the panel-side lower left connector 401*b* is provided at a position offset leftward by a third distance L3 in the left-right direction from the middle point between the left engagement rail 51 and right engagement rail 51 of the pair of left and right engagement rails 51 provided in the left region of the upper surface 30*a* of the base member 30. If the first panel member 41 is coupled to the base member 30, the panel-side lower right connector 401*d* is provided at a position offset leftward by the third distance L3 in the left-right direction from the middle point between the left engagement rail 51 and the right engagement rail 51 of the pair of left and right engagement rails 51 provided in the right region of the upper surface 30*a* of the base member 30.

The third distance L3 is a distance at which, if the first luggage cargo 21 and the second luggage cargo 22 are stacked on the upper surface 30*a* of the base member 30 by the left and right legs 52 engaging with the pair of left and right engagement rails 51 provided in the left region of the upper surface 30*a* of the base member 30 while the first panel member 41 is coupled to the base member 30, the panel-side lower left connector 401*b* is coupled to the luggage cargo-side connectors 200 of the first luggage cargo 21 and the second luggage cargo 22. Similarly, the third distance L3 is a distance at which, if the first luggage cargo 21 and the second luggage cargo 22 are stacked on the upper surface 30*a* of the base member 30 by the left and right legs 52 engaging with the pair of left and right engagement rails 51 provided in the right region of the upper surface 30*a* of the base member 30 while the first panel member 41 is coupled to the base member 30, the panel-side lower right connector 401*d* is coupled to the luggage cargo-side connectors 200 of the first luggage cargo 21 and the second luggage cargo 22. Accordingly, if the first luggage cargo 21 or the second luggage cargo 22 is stacked on the upper surface 30*a* of the base member 30 by the left and right legs 52 engaging with the pair of left and right engagement rails 51 provided in the left region of the upper surface 30*a* of the base member 30 while the first panel member 41 is coupled to the base member 30, the luggage cargo-side connector 200 of the first luggage cargo 21 or the second luggage cargo 22 is coupled and conducted to the panel-side lower left connector 401*b*. Similarly, if the first luggage cargo 21 or the second luggage cargo 22 is stacked on the upper surface 30*a* of the base member 30 by the left and right legs 52 engaging with the pair of left and right engagement rails 51 provided in the right region of the upper surface 30*a* of the base member 30 while the first panel member 41 is coupled to the base member 30, the luggage cargo-side connector 200 of the first luggage cargo 21 or the second luggage cargo 22 is coupled and conducted to the panel-side lower right connector 401*d*.

If the third luggage cargo 23 is stacked on the upper surface 30*a* of the base member 30 by engaging with the upper surface 30*a* of the base member 30 while the first panel member 41 is coupled to the base member 30, such that the flanges 52*a* of the legs 52 provided at the left end of the third luggage cargo 23 engage with the protruding portion 51*a* of the left engagement rail 51 between the pair of left and right engagement rails 51 provided in the left region of the upper surface 30*a* of the base member 30 among the two pairs of left and right engagement rails 51 provided on the upper surface 30*a* of the base member 30, and the flanges 52*a* of the legs 52 provided at the right end of the third luggage cargo 23 engage with the protruding portion 51*a* of the right engagement rail 51 between of the pair of left and right engagement rails 51 provided in the right region of the upper surface 30*a* of the base member 30 among the two pairs of left and right engagement rails 51 provided on the upper surface 30*a* of the base member 30, the panel-side lower left connector 401*b* is coupled to the luggage cargo-side connector 200 of the third luggage cargo 23. Accordingly, if the third luggage cargo 23 is stacked on the left region of the upper surface 30*a* of the base member 30 by the left and right legs 52 engaging with the left engagement rail 51 between the pair of left and right engagement rails 51 provided in the left region of the upper surface 30*a* of the base member 30 and the right engagement rail 51 between the pair of left and right engagement rails 51 provided in the right region of the upper surface 30*a* of the base member 30 while the first panel member 41 is coupled to the base member 30, the luggage cargo-side connector 200 of the third luggage cargo 23 is coupled and conducted to the panel-side lower left connector 401*b*.

The panel-side upper left connector 401*a* and the panel-side upper right connector 401*c* are provided at (twice the unit height dimension H1)+(first distance L1) above the lower surface of the first panel member 41 in the upper-lower direction. The panel-side upper left connector 401*a* is provided at the same position as the panel-side lower left connector 401*b* in the left-right direction. The panel-side upper right connector 401*c* is provided at the same position as the panel-side lower right connector 401*d* in the left-right direction.

The panel-side connector 400 provided in the second panel member 42 includes a panel-side upper left connector 402*a* provided in the upper left region of the front surface of the second panel member 42, a panel-side lower left connector 402*b* provided in the lower left region of the front surface of the second panel member 42, a panel-side upper right connector 402*c* provided in the upper right region of the front surface of the second panel member 42, and a panel-side lower right connector 402*d* provided in the lower right region of the front surface of the second panel member 42.

The panel-side lower left connector 402*b* and the panel-side lower right connector 402*d* are provided below the panel-side upper left connector 402*a* and the panel-side upper right connector 402*c* on the front surface of the second panel member 42. If the second panel member 42 is adjacent above the first panel member 41 and coupled to the first panel member 41 and the first luggage cargo 21 is stacked on the upper surface 30*a* of the base member 30 by the legs 52 of the first luggage cargo 21 engaging with the engagement rail 51 provided on the upper surface 30*a* of the base member 30, the panel-side lower left connector 402*b* and the panel-side lower right connector 402*d* are provided at the first distance L1 above the upper surface of the first luggage cargo 21 in the upper-lower direction. In the present embodiment, the height dimension of the first luggage cargo 21 and the height dimensions of the first panel member 41 and the second panel member 42 are all three times the unit height dimension H1, that is, 3×H1, and are the same dimension. The panel-side lower left connector 402*b* and the panel-side lower right connector 402*d* are provided at the first distance L1 above the lower surface of the second panel member 42 in the upper-lower direction. If the second panel member 42 is coupled to the first panel member 41, the panel-side lower left connector 402*b* is provided at the same position as the panel-side upper left connector 401*a* and the panel-side lower left connector 401*b* of the first panel member 41 in the left-right direction. If the second panel member 42 is coupled to the first panel member 41, the panel-side lower right connector 402*d* is provided at the same position as the panel-side upper right connector 401*c* and the panel-side lower right connector 401*d* of the first panel member 41 in the left-right direction.

If a different first luggage cargo 21 or a second luggage cargo 22 is stacked on the upper surface 21*b* of the first luggage cargo 21 such that the left and right legs 52 engage with the pair of left and right engagement rails 51 provided on the upper surface 21*b* of the first luggage cargo 21 while the second panel member 42 is adjacent above the first panel member 41 and coupled to the first panel member 41 and the first luggage cargo 21 is stacked on the upper surface 30*a* of the base member 30 by the legs 52 of the first luggage cargo 21 engaging with the engagement rail 51 provided in the left region of the upper surface 30*a* of the base member 30, the panel-side lower left connector 402*b* is coupled to the luggage cargo-side connector 200 of the different first luggage cargo 21 or the second luggage cargo 22 stacked on the upper surface 21*b* of the first luggage cargo 21. Similarly, if a different first luggage cargo 21 or a second luggage cargo 22 is stacked on the upper surface 21*b* of the first luggage cargo 21 such that the left and right legs 52 engage with the pair of left and right engagement rails 51 provided on the upper surface 21*b* of the first luggage cargo 21 while the second panel member 42 is adjacent above the first panel member 41 and coupled to the first panel member 41 and the first luggage cargo 21 is stacked on the upper surface 30*a* of the base member 30 by the legs 52 of the first luggage cargo 21 engaging with the engagement rail 51 provided in the right region of the upper surface 30*a* of the base member 30, the panel-side lower right connector 402*d* is coupled to the luggage cargo-side connector 200 of the different first luggage cargo 21 or the second luggage cargo 22 stacked on the upper surface 21*b* of the first luggage cargo 21.

Accordingly, if a different first luggage cargo 21 or a second luggage cargo 22 is stacked on the upper surface 21*b* of the first luggage cargo 21 such that the left and right legs 52 engage with the pair of left and right engagement rails 51 provided on the upper surface 21*b* of the first luggage cargo 21 while the second panel member 42 is adjacent above the first panel member 41 and coupled to the first panel member 41 and the first luggage cargo 21 is stacked on the upper surface 30*a* of the base member 30 by the legs 52 of the first luggage cargo 21 engaging with the engagement rail 51 provided in the left region of the upper surface 30*a* of the base member 30, the luggage cargo-side connector 200 of the first luggage cargo 21 or the second luggage cargo 22 stacked on the upper surface 21*b* of the first luggage cargo 21 is coupled and conducted to the panel-side lower left connector 402*b* of the second panel member 42 adjacent above the first panel member 41 and coupled to the first panel member 41. Similarly, if a different first luggage cargo 21 or a second luggage cargo 22 is stacked on the upper surface 21*b* of the first luggage cargo 21 such that the left and right legs 52 engage with the pair of left and right engagement rails 51 provided on the upper surface 21*b* of the first luggage cargo 21 while the second panel member 42 is adjacent above the first panel member 41 and coupled to the first panel member 41 and the first luggage cargo 21 is stacked on the upper surface 30*a* of the base member 30 by the legs 52 of the first luggage cargo 21 engaging with the engagement rail 51 provided in the right region of the upper surface 30*a* of the base member 30, the luggage cargo-side connector 200 of the first luggage cargo 21 or the second luggage cargo 22 stacked on the upper surface 21*b* of the first luggage cargo 21 is coupled and conducted to the panel-side lower right connector 402*d* of the second panel member 42 adjacent above the first panel member 41 and coupled to the first panel member 41.

The panel-side upper left connector 402*a* and the panel-side upper right connector 402*c* are provided above the panel-side lower left connector 402*b* and the panel-side lower right connector 402*d* on the second panel member 42. If the second panel member 42 is adjacent above the first panel member 41 and coupled to the first panel member 41 and the second luggage cargo 22 is stacked on the upper surface 30*a* of the base member 30 by the legs 52 of the second luggage cargo 22 engaging with the engagement rail 51 provided on the upper surface 30*a* of the base member 30, the panel-side upper left connector 402*a* and the panel-side upper right connector 402*c* are provided at the first distance L1 above the upper surface of the second luggage cargo 22 in the upper-lower direction. In the present embodiment, the height dimension of the second luggage cargo 22 is five times the unit height dimension H1, that is, 5×H1, and the height dimensions of the first panel member 41 and the second panel member 42 are three times the unit height dimension H1, that is, 3×H1. Therefore, the panel-side upper left connector 402*a* and the panel-side upper right connector 402*c* are provided at (twice the unit height dimension H1)+(first distance L1) above the lower surface of the second panel member 42 in the upper-lower direction. The panel-side upper left connector 402*a* is provided at the same position as the panel-side lower left connector 402*b* in the left-right direction. The panel-side upper right connector 402*c* is provided at the same position as the panel-side lower right connector 402*d* in the left-right direction.

If a first luggage cargo 21 or a different second luggage cargo 22 is stacked on the upper surface 22*b* of the second luggage cargo 22 such that the left and right legs 52 engage with the pair of left and right engagement rails 51 provided on the upper surface 22*b* of the second luggage cargo 22 while the second panel member 42 is adjacent above the first panel member 41 and coupled to the first panel member 41 and the second luggage cargo 22 is stacked on the upper surface 30*a* of the base member 30 by the legs 52 of the second luggage cargo 22 engaging with the engagement rail 51 provided in the left region of the upper surface 30*a* of the base member 30, the panel-side upper left connector 402*a* is coupled to the luggage cargo-side connector 200 of the first luggage cargo 21 or the different second luggage cargo 22 stacked on the upper surface 22*b* of the second luggage cargo 22. Similarly, if the first luggage cargo 21 or the different second luggage cargo 22 is stacked on the upper surface 22*b* of the second luggage cargo 22 such that the left and right legs 52 engage with the pair of left and right engagement rails 51 provided on the upper surface 22*b* of the second luggage cargo 22 while the second panel member 42 is adjacent above the first panel member 41 and coupled to the first panel member 41 and the second luggage cargo 22 is stacked on the upper surface 30*a* of the base member 30 by the legs 52 of the second luggage cargo 22 engaging with the engagement rail 51 provided in the right region of the upper surface 30*a* of the base member 30, the panel-side upper right connector 402*c* is coupled to the luggage cargo-side connector 200 of a first luggage cargo 21 or a different second luggage cargo 22 stacked on the upper surface 22*b* of the second luggage cargo 22.

Accordingly, if a first luggage cargo 21 or a different second luggage cargo 22 is stacked on the upper surface 22*b* of the second luggage cargo 22 such that the left and right legs 52 engage with the pair of left and right engagement rails 51 provided on the upper surface 22*b* of the second luggage cargo 22 while the second panel member 42 is adjacent above the first panel member 41 and coupled to the first panel member 41 and the second luggage cargo 22 is stacked on the upper surface 30*a* of the base member 30 by the legs 52 of the second luggage cargo 22 engaging with the engagement rail 51 provided in the left region of the upper surface 30*a* of the base member 30, the luggage cargo-side connector 200 of the first luggage cargo 21 or the second luggage cargo 22 stacked on the upper surface 22*b* of the second luggage cargo 22 is coupled and conducted to the panel-side upper left connector 402*a* of the second panel member 42 adjacent above the first panel member 41 and coupled to the first panel member 41. Similarly, if a first luggage cargo 21 or a different second luggage cargo 22 is stacked on the upper surface 22*b* of the second luggage cargo 22 such that the left and right legs 52 engage with the pair of left and right engagement rails 51 provided on the upper surface 22*b* of the second luggage cargo 22 while the second panel member 42 is adjacent above the first panel member 41 and coupled to the first panel member 41 and the second luggage cargo 22 is stacked on the upper surface 30*a* of the base member 30 by the legs 52 of the second luggage cargo 22 engaging with the engagement rail 51 provided in the right region of the upper surface 30*a* of the base member 30, the luggage cargo-side connector 200 of the first luggage cargo 21 or the second luggage cargo 22 stacked on the upper surface 22*b* of the second luggage cargo 22 is coupled and conducted to the panel-side upper right connector 402*c* of the second panel member 42 adjacent above the first panel member 41 and coupled to the first panel member 41.

Accordingly, for example, even if a plurality of luggage cargos 20 having different height dimensions, such as a first luggage cargo 21 and a first luggage cargo 21, a first luggage cargo 21 and a second luggage cargo 22, a second luggage cargo 22 and a first luggage cargo 21, or a second luggage cargo 22 and a second luggage cargo 22 are stacked in the upper-lower direction and stacked on the base member 30 in order from the bottom, the luggage cargo-side connector 200 of each luggage cargo 20 can be conducted to the panel-side connector 400 of the first panel member 41 or the second panel member 42, and the luggage cargos 20 can be supplied with electric power via the first panel member 41 or the second panel member 42.

As described above, the article storage device 10 includes the plurality of panel members 40 each provided with the panel-side connectors 400, the luggage cargos 20 are each provided with the luggage cargo-side connector 200 capable of conducting with the panel-side connectors 400, and the second panel member 42 can be coupled above the first panel member 41 coupled to the base member 30 in the upper-lower direction. Accordingly, even if the plurality of luggage cargos 20 are stacked in the upper-lower direction and stacked on the base member 30, the luggage cargo-side connectors 400 of each luggage cargo 20 can be conducted to the panel-side connector 200 of the first panel member 41 or the second panel member 42, and the luggage cargos 20 can be supplied with electric power through the first panel member 41 or the second panel member 42.

Further, as described above, if the second panel member 42 is coupled above a first panel member 41 or a different second panel member 42, the lower surface connector 40*d* is conducted to the upper surface connector 40*c* of the first panel member 41 or the second panel member 42 arranged below the second panel member 42, so that the plurality of panel members 40 coupled in the upper-lower direction at the rear end of the base member 30 are electrically connected to each other. Accordingly, since electric power can be supplied to each of the luggage cargos 20 via the panel member 40, the luggage cargos 20 do not need to have a configuration in which the luggage cargos 20 are conducted to each other, and the luggage cargos 20 can have a simple configuration.

Each luggage cargo 20 operates, for example, the above-described electronic lock with the electric power supplied via the first panel member 41 or the second panel member 42. In addition, each luggage cargo 20 may open and close the door members 21*a*, 22*a*, and 23*a* with the electric power supplied via the first panel member 41 or the second panel member 42.

Example of Stacking Luggage Cargos on Base Member

Figure 7:
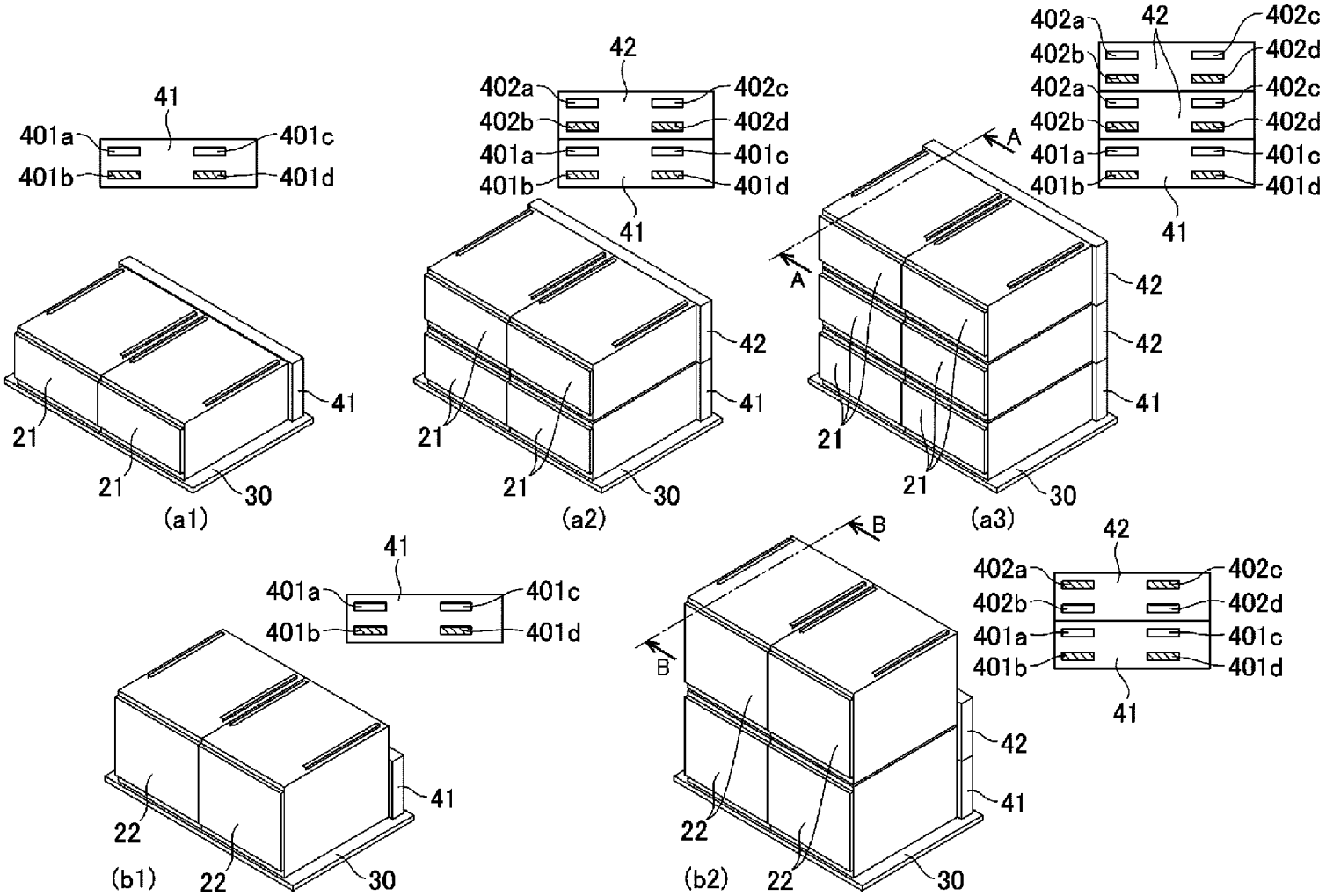
FIG. 7 is a diagram (Part 1) illustrating an example of stacking the luggage cargos on the base member in the article storage device of FIG. 1.
Figure 8:
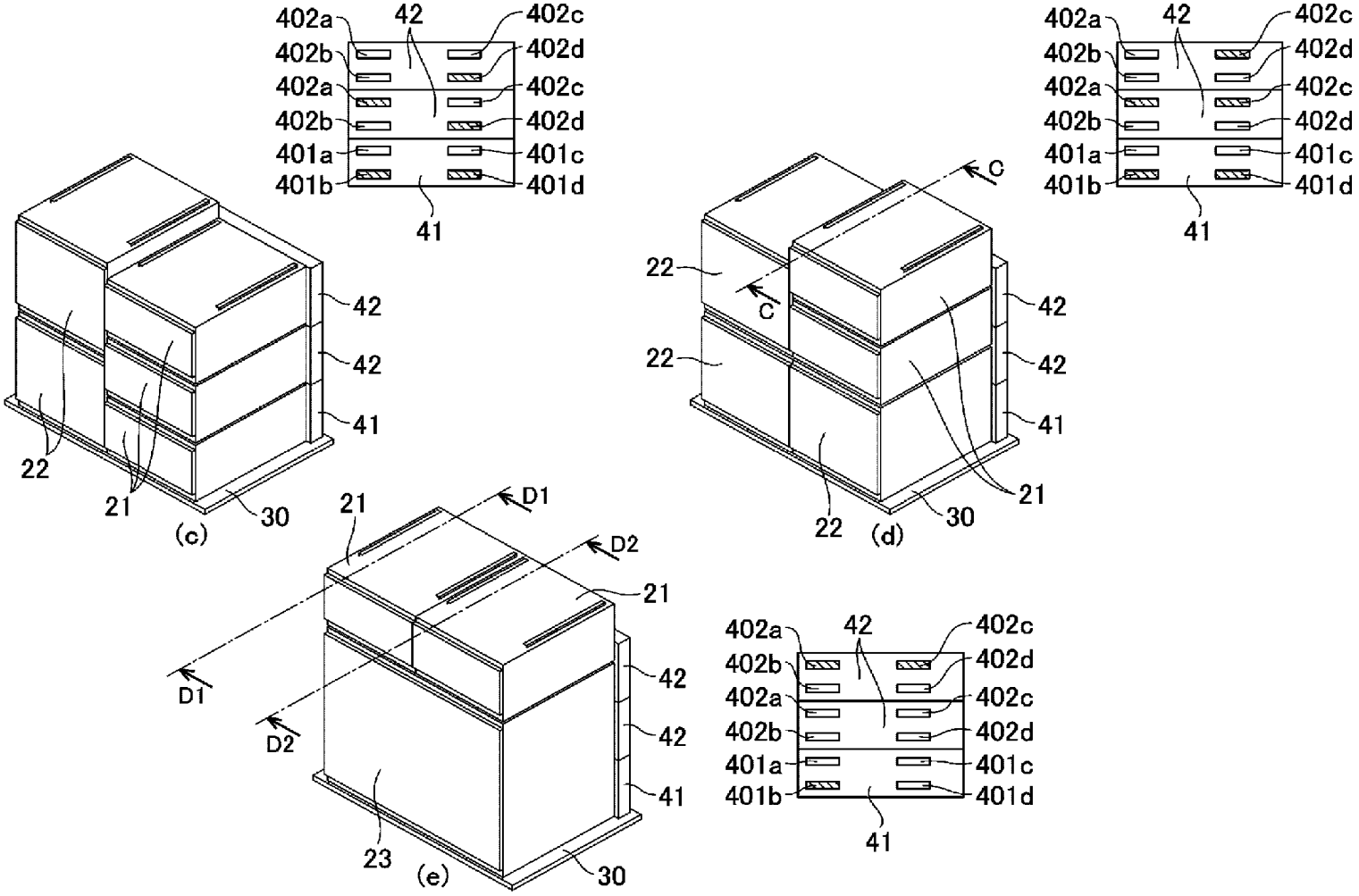
FIG. 8 is a diagram (Part 2) illustrating an example of stacking the luggage cargos on the base member in the article storage device of FIG. 1.

Next, an example of stacking the plurality of luggage cargo 20 on the base member 30 will be described with reference to FIGS. 7 and 8. Each luggage cargo 20 is stacked by engaging with engagement rails 51 provided on the base member 30 or the luggage cargo 20 adjacent below. In FIGS. 7 and 8, the panel-side connector 400 conducted to the luggage cargo-side connector 200 of the luggage cargo 20 is hatched.

In the stacking example illustrated in (a1) of FIG. 7, the left region and the right region of the upper surface 30*a* of the base member 30 each have one first luggage cargo 21 stacked therein. As for the panel members 40, only first panel members 41 coupled to the base member 30 are attached. At this time, the luggage cargo-side connector 200 of the first luggage cargo 21 stacked in the left region of the upper surface 30*a* of the base member 30 is conducted to the panel-side lower left connector 401*b* of the first panel member 41, and the luggage cargo-side connector 200 of the first luggage cargo 21 stacked in the right region of the upper surface 30*a* of the base member 30 is conducted to the panel-side lower right connector 401*d* of the first panel member 41.

In the stacking example illustrated in (a2) of FIG. 7, the left region and the right region of the upper surface 30*a* of the base member 30 each have two first luggage cargos 21 stacked therein. The panel member 40 includes a first panel member 41 coupled to the base member 30 and a second panel member 42 adjacent above the first panel member 41 and coupled to the first panel member 41. At this time, the luggage cargo-side connector 200 of the first luggage cargo 21 at the first stage from the bottom stacked in the left region of the upper surface 30*a* of the base member 30 is conducted to the panel-side lower left connector 401*b* of the first panel member 41, and the luggage cargo-side connector 200 of the first luggage cargo 21 at the second stage from the bottom stacked in the left region of the upper surface 30*a* of the base member 30 is conducted to the panel-side lower left connector 402*b* of the second panel member 42. The luggage cargo-side connector 200 of the first luggage cargo 21 at the first stage from the bottom stacked in the right region of the upper surface 30*a* of the base member 30 is conducted to the panel-side lower right connector 401*d* of the first panel member 41, and the luggage cargo-side connector 200 of the first luggage cargo 21 at the second stage from the bottom stacked in the right region of the upper surface 30*a* of the base member 30 is conducted to the panel-side lower right connector 402*d* of the second panel member 42.

In the stacking example illustrated in (a3) of FIG. 7, the left region and the right region of the upper surface 30*a* of the base member 30 each have three first luggage cargos 21 stacked therein. The panel members 40 include a first panel member 41 coupled to the base member 30, one second panel member 42 adjacent above the first panel member 41 and coupled to the first panel member 41, and another second panel member 42 adjacent above the one second panel member 42 and coupled to the one second panel member 42. At this time, the luggage cargo-side connector 200 of the first luggage cargo 21 at the first stage from the bottom stacked in the left region of the upper surface 30*a* of the base member 30 is conducted to the panel-side lower left connector 401*b* of the first panel member 41, the luggage cargo-side connector 200 of the first luggage cargo 21 at the second stage from the bottom stacked in the left region of the upper surface 30*a* of the base member 30 is conducted to the panel-side lower left connector 402*b* of the one second panel member 42, and the luggage cargo-side connector 200 of the first luggage cargo 21 at the third stage from the bottom stacked in the left region of the upper surface 30*a* of the base member 30 is conducted to the panel-side lower left connector 402*b* of the other second panel member 42. The luggage cargo-side connector 200 of the first luggage cargo 21 at the first stage from the bottom stacked in the right region of the upper surface 30*a* of the base member 30 is conducted to the panel-side lower right connector 401*d* of the first panel member 41, the luggage cargo-side connector 200 of the first luggage cargo 21 at the second stage from the bottom stacked in the right region of the upper surface 30*a* of the base member 30 is conducted to the panel-side lower right connector 402*d* of the one second panel member 42, and the luggage cargo-side connector 200 of the first luggage cargo 21 at the third stage from the bottom stacked in the right region of the upper surface 30*a* of the base member 30 is conducted to the panel-side lower right connector 402*d* of the other second panel member 42.

In the stacking example illustrated in (b1) of FIG. 7, the left region and the right region of the upper surface 30*a* of the base member 30 each have one second luggage cargo 22 stacked therein. As for the panel members 40, only first panel members 41 coupled to the base member 30 are attached. At this time, the luggage cargo-side connector 200 of the second luggage cargo 22 stacked in the left region of the upper surface 30*a* of the base member 30 is conducted to the panel-side lower left connector 401*b* of the first panel member 41, and the luggage cargo-side connector 200 of the second luggage cargo 22 stacked in the right region of the upper surface 30*a* of the base member 30 is conducted to the panel-side lower right connector 401*d* of the first panel member 41.

In the stacking example illustrated in (b2) of FIG. 7, the left region and the right region of the upper surface 30*a* of the base member 30 each have two second luggage cargos 22 stacked therein. The panel member 40 includes a first panel member 41 coupled to the base member 30 and a second panel member 42 adjacent above the first panel member 41 and coupled to the first panel member 41. At this time, the luggage cargo-side connector 200 of the second luggage cargo 22 at the first stage from the bottom stacked in the left region of the upper surface 30*a* of the base member 30 is conducted to the panel-side lower left connector 401*b* of the first panel member 41, and the luggage cargo-side connector 200 of the second luggage cargo 22 at the second stage from the bottom stacked in the left region of the upper surface 30*a* of the base member 30 is conducted to the panel-side upper left connector 402*a* of the second panel member 42. The luggage cargo-side connector 200 of the second luggage cargo 22 at the first stage from the bottom stacked in the right region of the upper surface 30*a* of the base member 30 is conducted to the panel-side lower right connector 401*d* of the first panel member 41, and the luggage cargo-side connector 200 of the second luggage cargo 22 at the second stage from the bottom stacked in the right region of the upper surface 30*a* of the base member 30 is conducted to the panel-side upper right connector 402*c* of the second panel member 42.

In the stacking example illustrated in (c) of FIG. 8, the left region of the upper surface 30*a* of the base member 30 has two second luggage cargos 22 stacked therein, and the right region of the upper surface 30*a* of the base member 30 has three first luggage cargos 21 stacked therein. The panel members 40 include a first panel member 41 coupled to the base member 30, one second panel member 42 adjacent above the first panel member 41 and coupled to the first panel member 41, and another second panel member 42 adjacent above the one second panel member 42 and coupled to the one second panel member 42. At this time, the luggage cargo-side connector 200 of the second luggage cargo 22 at the first stage from the bottom stacked in the left region of the upper surface 30*a* of the base member 30 is conducted to the panel-side lower left connector 401*b* of the first panel member 41, and the luggage cargo-side connector 200 of the second luggage cargo 22 at the second stage from the bottom stacked in the left region of the upper surface 30*a* of the base member 30 is conducted to the panel-side upper left connector 402*a* of the one second panel member 42. The luggage cargo-side connector 200 of the first luggage cargo 21 at the first stage from the bottom stacked in the right region of the upper surface 30*a* of the base member 30 is conducted to the panel-side lower right connector 401*d* of the first panel member 41, the luggage cargo-side connector 200 of the first luggage cargo 21 at the second stage from the bottom stacked in the right region of the upper surface 30*a* of the base member 30 is conducted to the panel-side lower right connector 402*d* of the one second panel member 42, and the luggage cargo-side connector 200 of the first luggage cargo 21 at the third stage from the bottom stacked in the right region of the upper surface 30*a* of the base member 30 is conducted to the panel-side lower right connector 402*d* of the other second panel member 42.

In the stacking example illustrated in (d) of FIG. 8, the left region of the upper surface 30*a* of the base member 30 has two second luggage cargos 22 stacked therein, and the right region of the upper surface 30*a* of the base member 30 has a second luggage cargo 22 stacked at the first stage from the bottom, a first luggage cargos 21 stacked at the second stage from the bottom, and a first luggage cargos 21 stacked at the third stage from the bottom. The panel members 40 include a first panel member 41 coupled to the base member 30, one second panel member 42 adjacent above the first panel member 41 and coupled to the first panel member 41, and another second panel member 42 adjacent above the one second panel member 42 and coupled to the one second panel member 42. At this time, the luggage cargo-side connector 200 of the second luggage cargo 22 at the first stage from the bottom stacked in the left region of the upper surface 30*a* of the base member 30 is conducted to the panel-side lower left connector 401*b* of the first panel member 41, and the luggage cargo-side connector 200 of the second luggage cargo 22 at the second stage from the bottom stacked in the left region of the upper surface 30*a* of the base member 30 is conducted to the panel-side upper left connector 402*a* of the one second panel member 42. The luggage cargo-side connector 200 of the second luggage cargo 22 at the first stage from the bottom stacked in the right region of the upper surface 30*a* of the base member 30 is conducted to the panel-side lower right connector 401*d* of the first panel member 41, the luggage cargo-side connector 200 of the first luggage cargo 21 at the second stage from the bottom stacked in the right region of the upper surface 30*a* of the base member 30 is conducted to the panel-side upper right connector 402*c* of the one second panel member 42, and the luggage cargo-side connector 200 of the first luggage cargo 21 at the third stage from the bottom stacked in the right region of the upper surface 30*a* of the base member 30 is conducted to the panel-side upper right connector 402*c* of the other second panel member 42.

In the stacking example illustrated in (e) of FIG. 8, the upper surface 30*a* of the base member 30 has a third luggage cargo 23 stacked thereon, the left region and the right region of the upper surface 23*b* of the third luggage cargo 23 each have a first luggage cargos 21 stacked thereon. The panel members 40 include a first panel member 41 coupled to the base member 30, one second panel member 42 adjacent above the first panel member 41 and coupled to the first panel member 41, and another second panel member 42 adjacent above the one second panel member 42 and coupled to the one second panel member 42. At this time, the luggage cargo-side connector 200 of the third luggage cargo 23 stacked on the upper surface 30*a* of the base member 30 is conducted to the panel-side lower left connector 401*b* of the first panel member 41. The luggage cargo-side connector 200 of the first luggage cargo 21 stacked in the left region of the upper surface 23*b* of the third luggage cargo 23 is conducted to the panel-side upper left connector 402*a* of the other second panel member 42. The luggage cargo-side connector 200 of the first luggage cargo 21 stacked in the right region of the upper surface 23*b* of the third luggage cargo 23 is conducted to the panel-side upper right connector 402*c* of the other second panel member 42.

In this way, by stacking a necessary number of second panel members 42 according to the configuration and arrangement of the plurality of luggage cargos 20 stacked on the base member 30, it is possible to supply electric power to the luggage cargos 20 even if the luggage cargos 20 having different dimensions are stacked in various arrangements. Further, by arranging the minimum necessary number of the second panel members 42 to be attached, it is possible to reduce the number of the panel-side connectors 400 that are not conducted to the luggage cargo-side connector 200.

<Dummy Connectors>

As illustrated in FIG. 9, the rear surface of each luggage cargo 20 is provided with dummy connectors 201. Each dummy connector 201 has a configuration such that, for example, the connector terminal 200*a* is omitted from a luggage cargo-side connector 200. Accordingly, the dummy connector 201 has a pair of left and right bushes that can be fitted to the positioning pins 400*c* of the panel-side connector 400. If a panel-side connector 400 is not conducted to the luggage cargo-side connector 200 while the luggage cargo 20 is stacked on the base member 30, the dummy connector 201 functions as a connector protection member that covers and protects the panel-side connector 400. If the luggage cargo 20 is stacked on the base member 30, the dummy connector 201 also functions as a panel engagement member that engages with the panel member 40 by fitting the positioning pins 400*c* of the panel-side connector 400 to the pair of left and right bushes.

The rear surface of each first luggage cargo 21 is provided with two dummy connectors 201. The two dummy connectors 201 provided on the rear surface of the first luggage cargo 21 are provided at the same position as the luggage cargo-side connector 200 in the left-right direction. The two dummy connectors 201 provided on the rear surface of the first luggage cargo 21 include a first dummy connector 211*a* provided at (unit height dimension H1)+(first distance L1) above the lower surface of the first luggage cargo 21 in the upper-lower direction, and a second dummy connector 211*b* provided at (twice the unit height dimension H1)+(first distance L1) above the lower surface of the first luggage cargo 21. Accordingly, the first dummy connector 211*a* and the second dummy connector 211*b* are provided above the luggage cargo-side connector 200 at intervals of the unit height dimension H1, and are aligned in the upper-lower direction together with the luggage cargo-side connector 200.

The rear surface of each second luggage cargo 22 is provided with two dummy connectors 201. The two dummy connectors 201 provided on the rear surface of the second luggage cargo 22 are provided at the same position as the luggage cargo-side connector 200 in the left-right direction. The two dummy connectors 201 provided on the rear surface of the second luggage cargo 22 include a first dummy connector 221*a* provided at (twice the unit height dimension H1)+(first distance L1) above the lower surface of the second luggage cargo 22 in the upper-lower direction, and a second dummy connector 221*b* provided at (three times the unit height dimension H1)+(first distance L1) above the lower surface of the second luggage cargo 22.

The rear surface of each third luggage cargo 23 is provided with nine dummy connectors 201. Four dummy connectors 201 among the nine dummy connectors 201 provided on the rear surface of the third luggage cargo 23 are provided at the same position as the luggage cargo-side connector 200 in the left-right direction. The four dummy connectors 201 provided at the same positions in the left-right direction as the luggage cargo-side connectors 200 are provided at (twice the unit height dimension H1)+(first distance L1) above the lower surface, (three times the unit height dimension H1)+(first distance L1) above the lower surface, (five times the unit height dimension H1)+(first distance L1) above the lower surface, and (six times the unit height dimension H1)+(first distance L1) above the lower surface in the upper-lower direction. If a third luggage cargo 23 is stacked on the upper surface 30*a* of the base member 30 by engaging with the upper surface 30*a* of the base member 30, the other five dummy connectors 201 among the nine dummy connectors 201 provided on the rear surface of the third luggage cargo 23 are provided at the same positions in the left-right direction as the panel-side upper right connector 401*c* and the panel-side lower right connector 401*d* of the first panel member 41 and the panel-side upper right connector 402*c* and the panel-side lower right connector 402*d* of the second panel member 42. The other five dummy connectors 201 among the nine dummy connectors 201 provided on the rear surface of the third luggage cargo 23 are provide at the first distance L1 above the lower surface, (twice the unit height dimension H1)+(first distance L1) above the lower surface, (three times the unit height dimension H1)+(first distance L1) above the lower surface, (five times the unit height dimension H1)+(first distance L1) above the lower surface, and (six times the unit height dimension H1)+(first distance L1) above the lower surface in the upper-lower direction.

Figure 10:
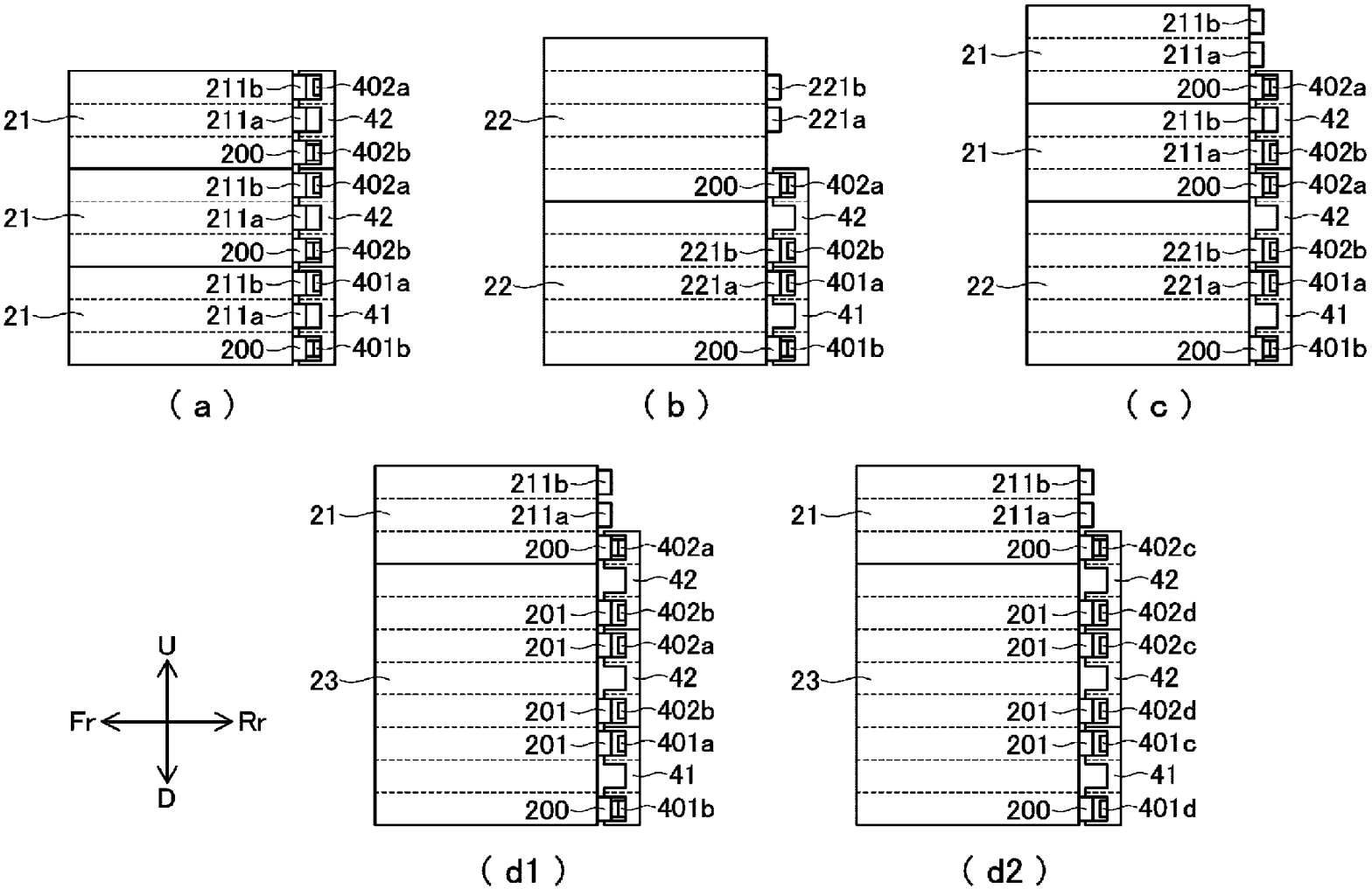
In FIG. 10, (a) is a schematic cross-sectional view taken along line A-A of FIG. 7, (b) is a schematic cross-sectional view taken along line B-B of FIG. 7, (c) is a schematic cross-sectional view taken along line C-C of FIG. 8, (d1) is a schematic cross-sectional view taken along line D1-D1 of FIG. 8, and (d2) is a schematic cross-sectional view taken along line D2-D2 of FIG. 8.

As illustrated in (a) of FIG. 10, if the left region of the upper surface 30*a* of the base member 30 has three first luggage cargos 21 stacked therein, the luggage cargo-side connector 200 of the first luggage cargo 21 at the first stage from the bottom is coupled and conducted to the panel-side lower left connector 401*b* of the first panel member 41. The second dummy connector 211*b* provided on the first luggage cargo 21 at the first stage from the bottom engages with the panel-side upper left connector 401*a* of the first panel member 41. The luggage cargo-side connector 200 of the first luggage cargo 21 at the second stage from the bottom is coupled and conducted to the panel-side lower left connector 402*b* of the one second panel member 42. The second dummy connector 211*b* provided on the first luggage cargo 21 at the second stage from the bottom engages with the panel-side upper left connector 402*a* of the one second panel member 42. The luggage cargo-side connector 200 of the first luggage cargo 21 at the third stage from the bottom is coupled and conducted to the panel-side lower left connector 402*b* of the other second panel member 42. The second dummy connector 211*b* provided on the first luggage cargo 21 at the third stage from the bottom engages with the panel-side upper left connector 402*a* of the other second panel member 42.

Although not illustrated, if the right region of the upper surface 30*a* of the base member 30 has three first luggage cargos 21 stacked therein, similarly, the luggage cargo-side connector 200 of the first luggage cargo 21 at the first stage from the bottom is coupled and conducted to the panel-side lower right connector 401*d* of the first panel member 41. The second dummy connector 211*b* provided on the first luggage cargo 21 at the first stage from the bottom engages with the panel-side upper right connector 401*c* of the first panel member 41. The luggage cargo-side connector 200 of the first luggage cargo 21 at the second stage from the bottom is coupled and conducted to the panel-side lower right connector 402*d* of the one second panel member 42. The second dummy connector 211*b* provided on the first luggage cargo 21 at the second stage from the bottom engages with the panel-side upper right connector 402*c* of the one second panel member 42. The luggage cargo-side connector 200 of the first luggage cargo 21 at the third stage from the bottom is coupled and conducted to the panel-side lower right connector 402*d* of the other second panel member 42. The second dummy connector 211*b* provided on the first luggage cargo 21 at the third stage from the bottom engages with the panel-side upper right connector 402*c* of the other second panel member 42.

As described above, the second dummy connector 211*b* provided in each first luggage cargo 21 engages with a panel-side connector 400 that is not conducted to the luggage cargo-side connector 200 among the panel-side connectors 400 provided in the first panel member 41 and the second panel member 42, and covers and protects the panel-side connector 400 that is not conducted to the luggage cargo-side connector 200. Accordingly, the second dummy connector 211*b* of the first luggage cargo 21 functions as a connector protection member that protects the panel-side connector 400 if the panel-side connector 400 is not conducted to the luggage cargo-side connector 200, and can prevent foreign matters such as water or dust from entering the panel-side connector 400 that is not conducted to the luggage cargo-side connector 200 and prevent the panel-side connector 400 that is not conducted to the luggage cargo-side connector 200 from being conducted to an unintended member. Further, the second dummy connector 211*b* of the first luggage cargo 21 functions as a panel engagement member that engages with a panel member 40, and the luggage cargo 20 can be supported by the panel member 40, so that it is possible to prevent the displacement of the luggage cargo 20 relative to the panel member 40, and it is possible to reliably conduct the luggage cargo-side connector 200 and the panel-side connector 400.

As illustrated in (b) of FIG. 10, if the left region of the upper surface 30*a* of the base member 30 has two second luggage cargos 22 stacked therein, the luggage cargo-side connector 200 of the second luggage cargo 22 at the lower stage is coupled and conducted to the panel-side lower left connector 401*b* of the first panel member 41. The first dummy connector 221*a* provided in the second luggage cargo 22 at the lower stage engages with the panel-side upper left connector 401*a* of the first panel member 41, and the second dummy connector 221*b* provided in the second luggage cargo 22 at the lower stage engages with the panel-side lower left connector 402*b* of the second panel member 42. In addition, the luggage cargo-side connector 200 of the second luggage cargo 22 at the upper stage is coupled and conducted to the panel-side upper left connector 402*a* of the second panel member 42.

Although not illustrated, if the right region of the upper surface 30*a* of the base member 30 has two second luggage cargos 22 stacked therein, the luggage cargo-side connector 200 of the second luggage cargo 22 at the lower stage is coupled and conducted to the panel-side lower right connector 401*d* of the first panel member 41. The first dummy connector 221*a* provided in the second luggage cargo 22 at the lower stage engages with the panel-side upper right connector 401*c* of the first panel member 41, and the second dummy connector 221*b* provided in the second luggage cargo 22 at the lower stage engages with the panel-side lower right connector 402*d* of the second panel member 42. The luggage cargo-side connector 200 of the second luggage cargo 22 at the upper stage is coupled and conducted to the panel-side upper right connector 402*c* of the second panel member 42.

As described above, the two dummy connectors 201 provided on the second luggage cargo 22 at the lower stage engage with panel-side connectors 400 that are not conducted to the luggage cargo-side connectors 200 among the panel-side connectors 400 provided in the first panel member 41 and the second panel member 42, and cover and protect the panel-side connectors 400 that are not conducted to the luggage cargo-side connectors 200. Accordingly, the dummy connectors 201 function as connector protection members that protect the panel-side connectors 400 that are not conducted to the luggage cargo-side connectors 200, and can prevent foreign matters such as water or dust from entering the panel-side connectors 400 that are not conducted to the luggage cargo-side connectors 200 and prevent the panel-side connectors 400 that are not conducted to the luggage cargo-side connectors 200 from being conducted to an unintended member. Further, the dummy connectors 201 function as panel engagement members that engage with a panel member 40, and can support the luggage cargo 20 on the panel member 40, so that it is possible to prevent the displacement of the luggage cargo 20 relative to the panel member 40, and it is possible to reliably conduct the luggage cargo-side connector 200 and the panel-side connector 400.

As illustrated in (c) of FIG. 10, if the right region of the upper surface 30*a* of the base member 30 has a second luggage cargo 22 stacked at the first stage from the bottom, a first luggage cargo 21 stacked at the second stage from the bottom, and a first luggage cargo 21 stacked at the third stage from the bottom, the luggage cargo-side connector 200 of the second luggage cargo 22 arranged at the first stage from the bottom is coupled and conducted to the panel-side lower right connector 401*d* of the first panel member 41. The first dummy connector 221*a* provided in the second luggage cargo 22 arranged at the first stage from the bottom engages with the panel-side upper right connector 401*c* of the first panel member 41, and the second dummy connector 221*b* provided in the second luggage cargo 22 arranged at the first stage from the bottom engages with the panel-side lower right connector 402*d* of one second panel member 42. The luggage cargo-side connector 200 of the first luggage cargo 21 arranged at the second stage from the bottom is coupled and conducted to the panel-side upper right connector 402*c* of the one second panel member 42. The first dummy connector 211*a* provided on the first luggage cargo 21 arranged at the second stage from the bottom engages with the panel-side lower right connector 402*d* of the other second panel member 42. The luggage cargo-side connector 200 of the first luggage cargo 21 arranged at the third stage from the bottom is coupled and conducted to the panel-side upper right connector 402*c* of the other second panel member 42.

As described above, the dummy connectors 201 provided on the first luggage cargo 21 and the second luggage cargo 22 engage with panel-side connectors 400 that are not conducted to the luggage cargo-side connectors 200 among the panel-side connectors 400 provided in the first panel member 41 and the second panel member 42, and cover and protect the panel-side connectors 400 that are not conducted to the luggage cargo-side connectors 200. Accordingly, the dummy connectors 201 function as connector protection members that protect the panel-side connectors 400 that are not conducted to the luggage cargo-side connectors 200, and can prevent foreign matters such as water or dust from entering the panel-side connectors 400 that are not conducted to the luggage cargo-side connectors 200 and prevent the panel-side connectors 400 that are not conducted to the luggage cargo-side connectors 200 from being conducted to an unintended member. Further, the dummy connectors 201 function as panel engagement members that engage with a panel member 40, and can support the luggage cargo 20 on the panel member 40, so that it is possible to prevent the displacement of the luggage cargo 20 relative to the panel member 40, and it is possible to reliably conduct the luggage cargo-side connector 200 and the panel-side connector 400.

In addition, since the first luggage cargo 21 is provided with the first dummy connector 211*a* and the second dummy connector 211*b* as described above, regardless of whether the first luggage cargo 21 engages with and is stacked on the upper surface of the base member 30, the first luggage cargo 21 or the second luggage cargo 22, the first dummy connector 211*a* and the second dummy connector 211*b* engage with a panel-side connector 400 that is not conducted to the luggage cargo-side connector 200 among the panel-side connectors 400 provided on the first panel member 41 and the second panel member 42, and the panel-side connector 400 that is not conducted to the luggage cargo-side connector 200 can be covered and protected.

As illustrated in (d1) and (d2) of FIG. 10, if the upper surface 30*a* of the base member 30 has a third luggage cargo 23 stacked thereon and the left region and the right region of the upper surface 23*b* of the third luggage cargo 23 each have one first luggage cargo 21 stacked therein, the luggage cargo-side connector 200 of the third luggage cargo 23 is coupled and conducted to the panel-side lower left connector 401*b* of the first panel member 41. The four dummy connectors 201 provided at the same positions in the left-right direction as the luggage cargo-side connectors 200 of the third luggage cargo 23 respectively engage with the panel-side upper left connector 401*a* of the first panel member 41, the panel-side lower left connector 402*b* of the one second panel member 42, the panel-side upper left connector 402*a* of the one second panel member 42, and the panel-side lower left connector 402*b* of the other second panel member 42 in order from the bottom. Further, the other five dummy connectors 201 among the nine dummy connectors 201 provided on the rear surface of the third luggage cargo 23 respectively engage with the panel-side lower right connector 401*d* of the first panel member 41, the panel-side upper right connector 401*c* of the first panel member 41, the panel-side lower right connector 402*d* of the one second panel member 42, the panel-side upper right connector 402*c* of the one second panel member 42, and the panel-side lower right connector 402*d* of the other second panel member 42 in order from the bottom. The luggage cargo-side connector 200 of the first luggage cargo 21 stacked in the left region of the upper surface 23*b* of the third luggage cargo 23 is coupled and conducted to the panel-side upper left connector 402*a* of the other second panel member 42. The luggage cargo-side connector 200 of the first luggage cargo 21 stacked in the right region of the upper surface 23*b* of the third luggage cargo 23 is coupled and conducted to the panel-side upper right connector 402*c* of the other second panel member 42.

As described above, since the nine dummy connectors 201 are provided in the third luggage cargo 23, even if a luggage cargo 20 is stacked on the upper surface 23*b* of the third luggage cargo 23, the dummy connectors 201 engage with panel-side connectors 400 that are not conducted to the luggage cargo-side connectors 200 among the panel-side connectors 400 provided in the first panel member 41 and the two second panel members 42, and can cover and protect the panel-side connectors 400 that are not conducted to the luggage cargo-side connectors 200.

Although an embodiment of the present disclosure has been described above with reference to the accompanying drawings, it is needless to say that the present invention is not limited to the embodiment. It is apparent that those skilled in the art can conceive of various modifications and changes within the scope described in the claims, and it is understood that such modifications and changes naturally fall within the technical scope of the present invention. In addition, the components in the above embodiment may be freely combined without departing from the gist of the invention.

For example, in the present embodiment, the dummy connectors 201 function as connector protection members that cover and protect the panel-side connectors 400 that are not conducted to the luggage cargo-side connector 200, and also functions as panel engagement members that engage with the panel members 40, but the connector protection members and the panel engagement members may be separate members.

In the present specification, at least the following matters are described. In parentheses, corresponding components and the like in the above embodiment are illustrated as an example, but the present invention is not limited thereto.

(1) An article storage device (article storage device 10), including:

a plurality of luggage cargos (luggage cargos 20) configured to store an article; and a base member (base member 30) configured to allow the plurality of luggage cargos to be stacked, in which an upper surface (upper surface 30*a*) of the base member and upper surfaces (upper surfaces 21*b*, 22*b*) of the luggage cargos are each provided with an engaging portion (engagement rails 51), lower surfaces (lower surfaces 21*c*, 22*c*) of the luggage cargos are each provided with an engaged portion (legs 52) configured to detachably engage with the engaging portion, the plurality of luggage cargos include a first luggage cargo (first luggage cargo 21) and a second luggage cargo (second luggage cargo 22) having the same width dimension and different height dimensions, and the luggage cargos are each configured to be stacked on the base member by the engaged portion engaging with the engaging portion of the base member or a different luggage cargo.

According to (1), the first luggage cargo and the second luggage cargo can be stacked on the base member by engaging with the base member, and the first luggage cargo and the second luggage cargo can be stacked on the upper surface of a first luggage cargo or a second luggage cargo below by engaging with the first luggage cargo or the second luggage cargo. Accordingly, the luggage cargos having different height dimensions can be stacked in the upper-lower direction by engaging with the base member and the luggage cargo below, so that the luggage cargos having different height dimensions can be stacked on the base member while being combined with a high degree of freedom in the upper-lower direction, without moving relative to the base member or the luggage cargo below.

(2) An article storage device (article storage device 10), including:

a plurality of luggage cargos (luggage cargos 20) configured to store an article;

a base member (base member 30) configured to allow the plurality of luggage cargos to be stacked; and a panel member (panel member 40) provided with a panel-side connector (panel-side connector 400), in which an upper surface (upper surface 30*a*) of the base member is provided with an engaging portion (engagement rails 51), the luggage cargos are each provided with a luggage cargo-side connector (luggage cargo-side connector 200) configured to be conducted to the panel-side connector, lower surfaces (lower surfaces 21*c*, 22*c*) of the luggage cargos area each provided with an engaged portion (legs 52) configured to detachably engage with the engaging portion, the plurality of luggage cargos include a first luggage cargo (first luggage cargo 21) and a second luggage cargo (second luggage cargo 22) having the same width dimension and different height dimensions, the panel member is coupled to the base member, and the luggage cargos are each configured to be stacked on the base member by the engaged portion engaging with the engaging portion of the base member.

According to (2), the first luggage cargo and the second luggage cargo can be stacked on the base member by engaging with the base member, and the first luggage cargo and the second luggage cargo can be conducted to the panel member coupled to the base member. Accordingly, the luggage cargos having different height dimensions can be stacked while being coupled to the base member and the panel member, so that the luggage cargos having different height dimensions can be stacked on the base member while being combined with a high degree of freedom by coupling the luggage cargos to the base member and the panel member.

(3) The article storage device according to (1) or (2), further including:

a plurality of panel members (panel members 40) each provided with a panel-side connector (panel-side connector 400), in which the luggage cargos are each provided with a luggage cargo-side connector (luggage cargo-side connector 200) configured to be conducted with the panel-side connector, the plurality of panel members include a first panel member (first panel member 41) and a second panel member (second panel member 42), the first panel member is coupled to the base member, and the second panel member is configured to be detachably coupled to the first panel member or a different second panel member in an upper-lower direction.

According to (3), the plurality of panel members are each provided with a panel-side connector, the luggage cargos are each provided with the luggage cargo-side connector capable of conducting with the panel-side connector, and the second panel member can be coupled above the first panel member coupled to the base member in the upper-lower direction. Accordingly, even if the plurality of luggage cargos are stacked in the upper-lower direction and stacked on the base member, the luggage cargo-side connector of each luggage cargo can be conducted to the panel-side connector of the first panel member or the second panel member, and the luggage cargos can be supplied with electric power through the first panel member or the second panel member.

(4) The article storage device according to (2) or (3), in which the luggage cargos are each provided with a connector protection member (dummy connector 201) configured to protect the panel-side connector if the panel-side connector is not conducted to the luggage cargo-side connector while the luggage cargo is stacked on the base member.

According to (4), the luggage cargo is provided with the connector protection member for protecting the panel-side connector that is not conducted to the luggage cargo-side connector if the luggage cargo is stacked on the base member, so that it is possible to prevent foreign matters such as water or dust from entering a panel-side connector that is not conducted to the luggage cargo-side connector, and to prevent a panel-side connector that is not conducted to the luggage cargo-side connector from being conducted to an unintended member.

(5) The article storage device according to any one of (2) to (4), in which the luggage cargos are each provided with a panel engagement member (dummy connector 201) configured to engage with the panel member if the luggage cargo is stacked on the base member.

According to (5), since the luggage cargo is provided with the panel engagement member that engages with the panel member if the luggage cargo is stacked on the base member, the luggage cargo can be supported by the panel member. Accordingly, it is possible to prevent the displacement of the luggage cargo relative to the panel member, and it is possible to reliably conduct the luggage cargo-side connector and the panel-side connector.

(6) The article storage device according to (3), in which if the luggage cargo is stacked on the upper surface of the base member by the engaged portion of the luggage cargo engaging with the engaging portion provided on the upper surface of the base member, the luggage cargo-side connector is provided at a first distance (first distance L1) above the upper surface of the base member in the upper-lower direction, if the first panel member is coupled to the base member, the panel-side connector provided on the first panel member is provided at the first distance above the upper surface of the base member in the upper-lower direction, the luggage cargo stacked on the upper surface of the base member by the engaged portion engaging with the engaging portion provided on the upper surface of the base member has the luggage cargo-side connector conducted to the panel-side connector provided on the first panel member, the second panel member is provided with a plurality of panel-side connectors, the panel-side connectors provided on the second panel member include a panel-side upper connector (panel-side upper left connectors 401*a*, 402*a* and panel-side upper right connectors 401*c*, 402*c*) and a panel-side lower connector (panel-side lower left connectors 401*b*, 402*b* and panel-side lower right connectors 401*d*, 402*d*) aligned in the upper-lower direction, an upper-lower dimension of the second luggage cargo is larger than an upper-lower dimension of the first luggage cargo, the panel-side lower connector is provided below the panel-side upper connector in the second panel member, if the second panel member is adjacent above the first panel member and coupled to the first panel member and the first luggage cargo is stacked on the upper surface of the base member by the engaged portion of the first luggage cargo engaging with the engaging portion provided on the upper surface of the base member, the panel-side lower connector is provided at the first distance above the upper surface of the first luggage cargo in the upper-lower direction, if the first luggage cargo is stacked on the upper surface of the base member by the engaged portion of the first luggage cargo engaging with the engaging portion provided on the upper surface of the base member, the engaged portion is engaged with the engaging portion provided on the upper surface of the first luggage cargo, and the luggage cargo-side connector of the second luggage cargo stacked on the upper surface of the first luggage cargo is conducted to the panel-side lower connector of the second panel member adjacent above the first panel member and coupled to the first panel member, the panel-side upper connector is provided above the panel-side lower connector in the second panel member, if the second panel member is adjacent above the first panel member and coupled to the first panel member and the second luggage cargo is stacked on the upper surface of the base member by the engaged portion of the second luggage cargo engaging with the engaging portion provided on the upper surface of the base member, the panel-side upper connector is provided at the first distance above the upper surface of the second luggage cargo in the upper-lower direction, and if the second luggage cargo is stacked on the upper surface of the base member by the engaged portion of the second luggage cargo engaging with the engaging portion provided on the upper surface of the base member, the engaged portion is engaged with the engaging portion provided on the upper surface of the second luggage cargo, and the luggage cargo-side connector of the luggage cargo stacked on the upper surface of the second luggage cargo is conducted to the panel-side upper connector of the second panel member adjacent above the first panel member and coupled to the first panel member.

According to (6), even if the plurality of luggage cargos having different height dimensions are stacked in the upper-lower direction and stacked on the base member, the luggage cargo-side connector of each luggage cargo can be conducted to the panel-side connector of the first panel member or the second panel member. Accordingly, even if the plurality of luggage cargos having different height dimensions are stacked in the upper-lower direction and stacked on the base member, the luggage cargos can be supplied with electric power via the first panel member or the second panel member.

(7) The article storage device according to (6), in which the second luggage cargo is provided with a protection member (first dummy connector 221*a*, second dummy connector 221*b*), and if the second panel member is adjacent above the first panel member and coupled to the first panel member and the second luggage cargo is stacked on the upper surface of the base member by the engaged portion engaging with the engaging portion provided on the upper surface of the base member, the protection member protects the panel-side upper connector of the first panel member 41 or the panel-side lower connector of the second panel member adjacent above the first panel member and coupled to the first panel member.

According to (7), due to the protection member provided on the second luggage cargo, the protection member engages with a panel-side connector that is not conducted to the luggage cargo-side connector among the panel-side connectors provided on the first panel member and the second panel member, and the panel-side connector that is not conducted to the luggage cargo-side connector can be protected.

(8) The article storage device according to (7), in which the first luggage cargo is provided with a first protection member (first dummy connector 211*a*) and a second protection member (second dummy connector 211*b*), if one second panel member is adjacent above the first panel member and coupled to the first panel member, another second panel member is adjacent above the one second panel member and coupled to the one second panel member, the second luggage cargo is stacked on the upper surface of the base member by the engaged portion of the second luggage cargo engaging with the engaging portion provided on the upper surface of the base member, and the first luggage cargo is stacked on the upper surface of the second luggage cargo by the engaged portion engaging with the engaging portion provided on the upper surface of the second luggage cargo, the first protection member protects the panel-side lower connector of said another second panel member, and if the second panel member is adjacent above the first panel member and coupled to the first panel member, the first luggage cargo is stacked on the upper surface of the base member by the engaged portion of the first luggage cargo engaging with the engaging portion provided on the upper surface of the base member, and another first luggage cargo is stacked on the upper surface of the first luggage cargo by the engaged portion of said another luggage cargo engaging with the engaging portion provided on the upper surface of the first luggage cargo, the second protection member protects the panel-side upper connector of the second panel member adjacent above the first panel member and coupled to the first panel member.

According to (8), due to the first protection member and the second protection member provided on the first luggage cargo, regardless of whether the first luggage cargo engages with and is stacked on the upper surface of the base member, the first luggage cargo or the second luggage cargo, the first protection member and the second protection member engage with a panel-side connector that is not conducted to the luggage cargo-side connector among the panel-side connectors provided on the first panel member and the second panel member, and the panel-side connector that is not conducted to the luggage cargo-side connector can be protected.

(9) The article storage device according to any one of (3) and (6) to (8), in which the first panel member and the second panel member are each provided with a first inter-panel connector (upper surface connector 40*c*), the second panel member is provided with a second inter-panel connector (lower surface connector 40*d*) configured to be conducted to the first inter-panel connector, and if the second panel member is coupled above the first panel member or a different second panel member, the second inter-panel connector is conducted to the first inter-panel connector of the first panel member or the second panel member arranged below the second panel member.

According to (9), if the second panel member is coupled above the first panel member or the different second panel member, the second inter-panel connector is conducted to the first inter-panel connector of the first panel member or the second panel member arranged below the second panel member, so that the plurality of panel members coupled to the base member in the upper-lower direction are electrically connected to each other. Accordingly, since electric power can be supplied to each of the luggage cargos via the panel member, the luggage cargos do not need to have a configuration in which the luggage cargos are conducted to each other, and the luggage cargos can have a simple configuration.

REFERENCE SIGNS LIST

10: article storage device
20: luggage cargo
200: luggage cargo-side connector
201: dummy connector (connector protection member, panel engagement member)
21: first luggage cargo
21*b*: upper surface
21*c*: lower surface
211*a*: first dummy connector (first protection member)
211*b*: second dummy connector (second protection member)
22: second luggage cargo
22*b*: upper surface
22*c*: lower surface
221*a*: first dummy connector (protection member)
221*b*: second dummy connector (protection member)
30: base member
30*a* upper surface
40: panel member
40*c*: upper surface connector (first inter-panel connector)
40*d*: lower surface connector (second inter-panel connector)
400: panel-side connector
401*a*: panel-side upper left connector (panel-side upper connector)
401*b*: panel-side lower left connector (panel-side lower connector)
401*c*: panel-side upper right connector (panel-side upper connector)
401*d*: panel-side lower right connector (panel-side lower connector)
402*a*: panel-side upper left connector (panel-side upper connector)
402*b*: panel-side lower left connector (panel-side lower connector)
402*c*: panel-side upper right connector (panel-side upper connector)
402*d*: panel-side lower right connector (panel-side lower connector)
41: first panel member
42: second panel member
51: engagement rail (engaging portion)
52: leg (engaged portion)
L1: first distance

The invention claimed is:

1. An article storage device, comprising:

a plurality of luggage cargos configured to store an article; and a base member configured to allow the plurality of luggage cargos to be stacked; and a plurality of panel members each provided with a panel-side connector, wherein an upper surface of the base member and upper surfaces of the luggage cargos are each provided with an engaging portion, lower surfaces of the luggage cargos are each provided with an engaged portion configured to detachably engage with the engaging portion, the plurality of luggage cargos include a first luggage cargo and a second luggage cargo having a same width dimension and different height dimensions, the luggage cargos are each configured to be stacked on the base member by the engaged portion engaging with the engaging portion of the base member or a different luggage cargo, the luggage cargos are each provided with a luggage cargo-side connector configured to be conducted with the panel-side connector, the plurality of panel members include a first panel member and a second panel member, the first panel member is coupled to the base member, and the second panel member is configured to be detachably coupled to the first panel member or a different second panel member in an upper-lower direction.

2. The article storage device according to claim 1, wherein the luggage cargos are each provided with a connector protection member configured to protect the panel-side connector in a case where the panel-side connector is not conducted to the luggage cargo-side connector while the luggage cargo is stacked on the base member.

3. The article storage device according to claim 1, wherein the luggage cargos are each provided with a panel engagement member configured to engage with the panel member in a case where the luggage cargo is stacked on the base member.

4. The article storage device according to claim 1, wherein in a case where the luggage cargo is stacked on the upper surface of the base member by the engaged portion of the luggage cargo engaging with the engaging portion provided on the upper surface of the base member, the luggage cargo-side connector is provided at a first distance above the upper surface of the base member in the upper-lower direction, in a case where the first panel member is coupled to the base member, the panel-side connector provided on the first panel member is provided at the first distance above the upper surface of the base member in the upper-lower direction, the luggage cargo stacked on the upper surface of the base member by the engaged portion engaging with the engaging portion provided on the upper surface of the base member has the luggage cargo-side connector conducted to the panel-side connector provided on the first panel member, the second panel member is provided with a plurality of panel-side connectors, the panel-side connectors provided on the second panel member include a panel-side upper connector and a panel-side lower connector aligned in the upper-lower direction, an upper-lower dimension of the second luggage cargo is larger than an upper-lower dimension of the first luggage cargo, the panel-side lower connector is provided below the panel-side upper connector in the second panel member, in a case where the second panel member is adjacent above the first panel member and coupled to the first panel member and the first luggage cargo is stacked on the upper surface of the base member by the engaged portion of the first luggage cargo engaging with the engaging portion provided on the upper surface of the base member, the panel-side lower connector is provided at the first distance above the upper surface of the first luggage cargo in the upper-lower direction, in a case where the first luggage cargo is stacked on the upper surface of the base member by the engaged portion of the first luggage cargo engaging with the engaging portion provided on the upper surface of the base member, the engaged portion is engaged with the engaging portion provided on the upper surface of the first luggage cargo, and the luggage cargo-side connector of the second luggage cargo stacked on the upper surface of the first luggage cargo is conducted to the panel-side lower connector of the second panel member adjacent above the first panel member and coupled to the first panel member, the panel-side upper connector is provided above the panel-side lower connector in the second panel member, in a case where the second panel member is adjacent above the first panel member and coupled to the first panel member and the second luggage cargo is stacked on the upper surface of the base member by the engaged portion of the second luggage cargo engaging with the engaging portion provided on the upper surface of the base member, the panel-side upper connector is provided at the first distance above the upper surface of the second luggage cargo in the upper-lower direction, and in a case where the second luggage cargo is stacked on the upper surface of the base member by the engaged portion of the second luggage cargo engaging with the engaging portion provided on the upper surface of the base member, the engaged portion is engaged with the engaging portion provided on the upper surface of the second luggage cargo, and the luggage cargo-side connector of the luggage cargo stacked on the upper surface of the second luggage cargo is conducted to the panel-side upper connector of the second panel member adjacent above the first panel member and coupled to the first panel member.

5. The article storage device according to claim 4, wherein the second luggage cargo is provided with a protection member, and in a case where the second panel member is adjacent above the first panel member and coupled to the first panel member and the second luggage cargo is stacked on the upper surface of the base member by the engaged portion engaging with the engaging portion provided on the upper surface of the base member, the protection member protects the panel-side upper connector of the first panel member or the panel-side lower connector of the second panel member adjacent above the first panel member and coupled to the first panel member.

6. The article storage device according to claim 5, wherein the first luggage cargo is provided with a first protection member and a second protection member, in a case where one second panel member is adjacent above the first panel member and coupled to the first panel member, another second panel member is adjacent above the one second panel member and coupled to the one second panel member, the second luggage cargo is stacked on the upper surface of the base member by the engaged portion of the second luggage cargo engaging with the engaging portion provided on the upper surface of the base member, and the first luggage cargo is stacked on the upper surface of the second luggage cargo by the engaged portion engaging with the engaging portion provided on the upper surface of the second luggage cargo, the first protection member protects the panel-side lower connector of the another second panel member, and in a case where the second panel member is adjacent above the first panel member and coupled to the first panel member, the first luggage cargo is stacked on the upper surface of the base member by the engaged portion of the first luggage cargo engaging with the engaging portion provided on the upper surface of the base member, and another first luggage cargo is stacked on the upper surface of the first luggage cargo by the engaged portion of the another first luggage cargo engaging with the engaging portion provided on the upper surface of the first luggage cargo, the second protection member protects the panel-side upper connector of the second panel member adjacent above the first panel member and coupled to the first panel member.

7. The article storage device according to claim 1, wherein the first panel member and the second panel member are each provided with a first inter-panel connector, the second panel member is provided with a second inter-panel connector configured to be conducted to the first inter-panel connector, and in a case where the second panel member is coupled above the first panel member or a different second panel member, the second inter-panel connector is conducted to the first inter-panel connector of the first panel member or the second panel member arranged below the second panel member.

8. The article storage device according to claim 4, wherein the second luggage cargo is provided with a protection member, and in a case where the second panel member is adjacent above the first panel member and coupled to the first panel member and the second luggage cargo is stacked on the upper surface of the base member by the engaged portion engaging with the engaging portion provided on the upper surface of the base member, the protection member protects the panel-side upper connector of the first panel member or the panel-side lower connector of the second panel member adjacent above the first panel member and coupled to the first panel member.

9. The article storage device according to claim 8, wherein the first luggage cargo is provided with a first protection member and a second protection member, in a case where one second panel member is adjacent above the first panel member and coupled to the first panel member, another second panel member is adjacent above the one second panel member and coupled to the one second panel member, the second luggage cargo is stacked on the upper surface of the base member by the engaged portion of the second luggage cargo engaging with the engaging portion provided on the upper surface of the base member, and the first luggage cargo is stacked on the upper surface of the second luggage cargo by the engaged portion engaging with the engaging portion provided on the upper surface of the second luggage cargo, the first protection member protects the panel-side lower connector of the another second panel member, and in a case where the second panel member is adjacent above the first panel member and coupled to the first panel member, the first luggage cargo is stacked on the upper surface of the base member by the engaged portion of the first luggage cargo engaging with the engaging portion provided on the upper surface of the base member, and another first luggage cargo is stacked on the upper surface of the first luggage cargo by the engaged portion of the another first luggage cargo engaging with the engaging portion provided on the upper surface of the first luggage cargo, the second protection member protects the panel-side upper connector of the second panel member adjacent above the first panel member and coupled to the first panel member.

* * * * *